US005623144A

United States Patent [19]

Yoshinari et al.

[11] Patent Number: 5,623,144

[45] Date of Patent: Apr. 22, 1997

[54] MASS SPECTROMETER RING-SHAPED ELECTRODE HAVING HIGH ION SELECTION EFFICIENCY AND MASS SPECTROMETRY METHOD THEREBY

[75] Inventors: Kiyomi Yoshinari, Hitachi; Yoichi Ose; Yoshiaki Kato, both of Mito, all of Japan

[73] Assignee: Hitachi, Ltd., Japan

[21] Appl. No.: 598,890

[22] Filed: Feb. 9, 1996

[30] Foreign Application Priority Data

Feb. 14, 1995 [JP] Japan ..... 7-024950
Apr. 12, 1995 [JP] Japan ..... 7-087071

[51] Int. Cl.[6] ..... H01J 49/42

[52] U.S. Cl. ..... 250/281; 250/282; 250/292

[58] Field of Search ..... 250/292, 293, 250/291, 290, 281, 282, 286

[56] References Cited

U.S. PATENT DOCUMENTS 5,182,451 1/1993 Schwartz et al. ..... 250/282
5,352,890 10/1994 Johnson et al. ..... 250/292

FOREIGN PATENT DOCUMENTS 63-313460A 12/1988 Japan .
1-258353A 10/1989 Japan .
2-103856A 4/1990 Japan .

*Primary Examiner*—Michael J. Tokar
*Assistant Examiner*—Kiet T. Nguyen
*Attorney, Agent, or Firm*—Kenyon & Kenyon

[57] ABSTRACT

A mass spectrometer and a mass spectrometry method having a high ion selection efficiency are provided. The mass spectrometer comprises an ion trap, a sample introducing device, an electron gun, a detector, a power supply for applying voltage to the ion trap, a control device for controlling the power supply and the electron gun, a mass analyzing device for performing mass spectrometry based on a detected signal of the detector. Using an auxiliary power supply, direction of an auxiliary electric field generated between end cap electrodes is made to point only toward the detector. In this occasion, by setting the cycle of the auxiliary voltage near the oscillation cycle of interest ion species in the axial direction, the interest ion species are synchronized with the auxiliary electric field to be certainly unstabilized in the detector side.

26 Claims, 20 Drawing Sheets

FIG. 1
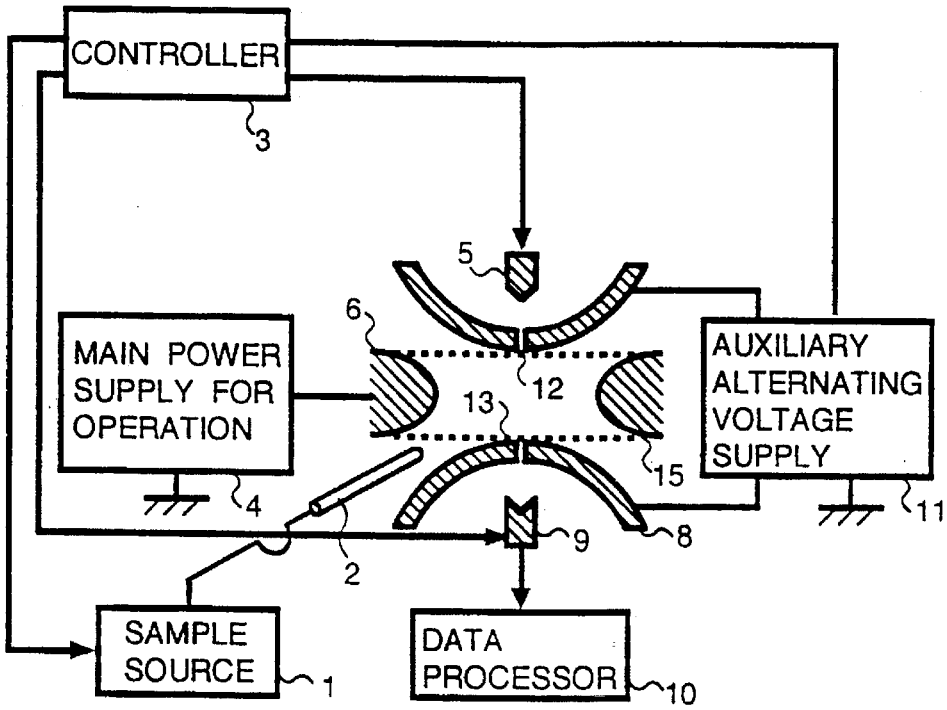
FIG. 2A *PRIOR ART*
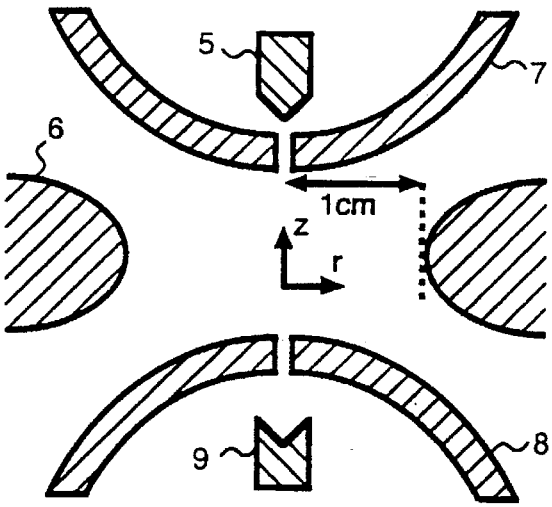

FIG. 3 *PRIOR ART*
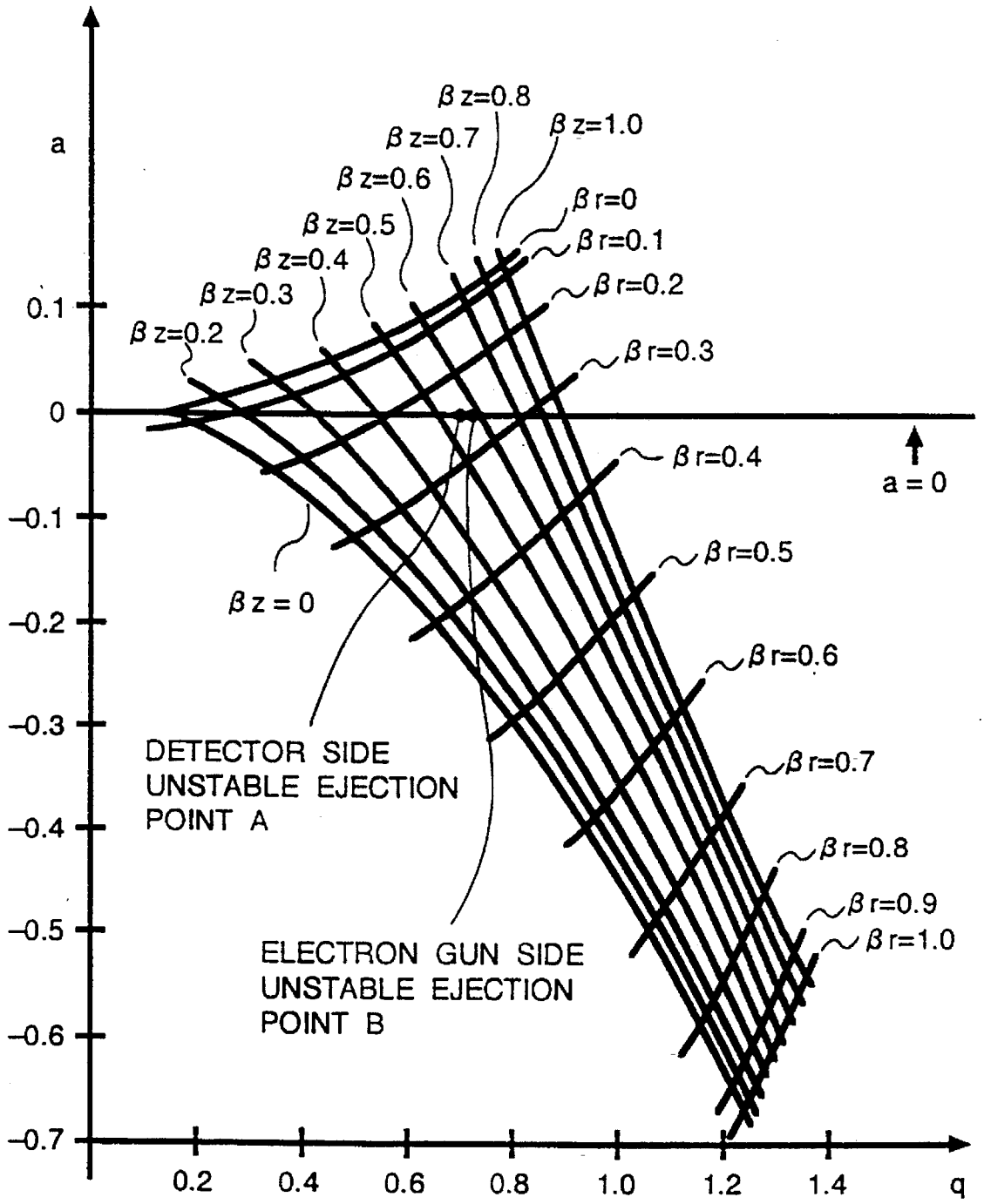

FIG. 12
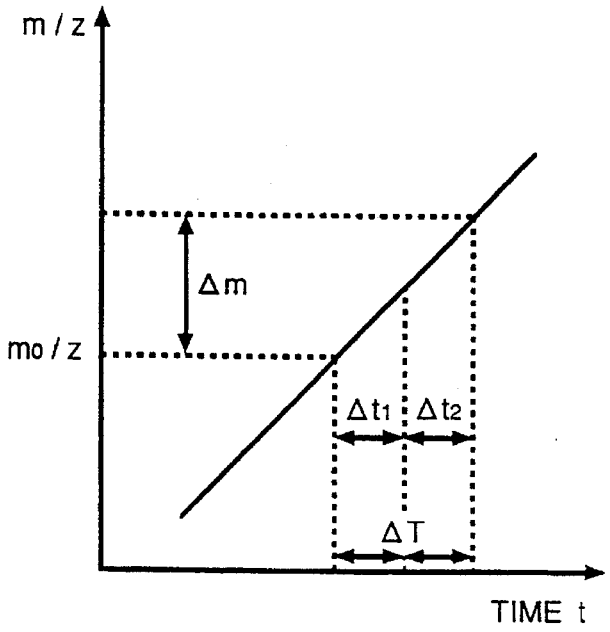
FIG. 13 *PRIOR ART*
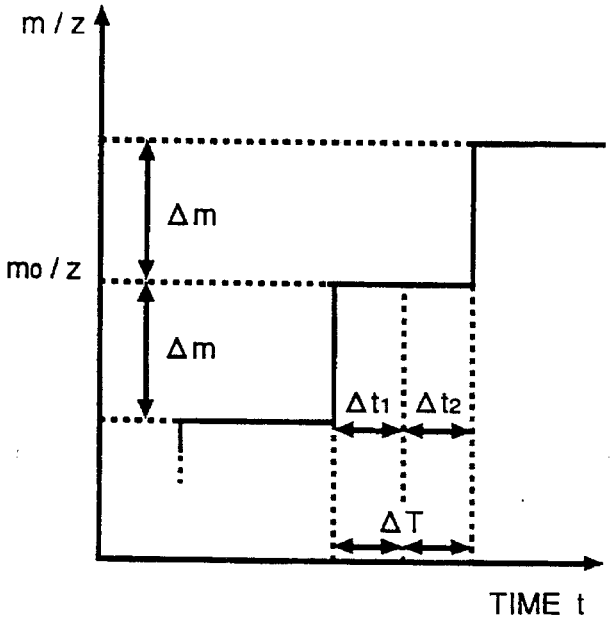

DETECTED RANGE IN MASS-TO-CHANGE RATIO : WHEN $M_1 \sim M_n$

⇩

SCANNING RANGE OF R.F. VOLTAGE: $M_1 \sim M_n$ $V_1$ : AMPLITUDE OF R.F. VOLTAGE CORRESPONDING TO MASS-TO-CHANGE RATIO $M_1$ $V_n$ : AMPLITUDE OF R.F. VOLTAGE CORRESPONDING TO MASS-TO-CHANGE RATIO $M_n$ $Ti \propto Mi \ (i = 1 \sim n)$ (Ti : i ANALYZING TIME ALLOCATED TO i-TH ION)

DETECTED RANGE IN MASS-TO-CHANGE RATIO : WHEN $M_1 \sim M_n$

⇩

SCANNING RANGE OF R.F. VOLTAGE: $M_1 \sim M_n$

- $V_1$ : AMPLITUDE OF R.F. VOLTAGE CORRESPONDING TO MASS-TO-CHANGE RATIO $M_1$
- $V_n$ : AMPLITUDE OF R.F. VOLTAGE CORRESPONDING TO MASS-TO-CHANGE RATIO $M_n$

DETECTED RANGE IN MASS-TO-CHANGE RATIO : WHEN $M_1 \sim M_n$

⇩

SCANNING RANGE OF R.F. VOLTAGE: $M_1 \sim M_n$

- $V_1$ : AMPLITUDE OF R.F. VOLTAGE CORRESPONDING TO MASS-TO-CHANGE RATIO $M_1$
- $V_n$ : AMPLITUDE OF R.F. VOLTAGE CORRESPONDING TO MASS-TO-CHANGE RATIO $M_n$

DETECTED RANGE IN MASS-TO-CHANGE RATIO : WHEN $M_1 \sim M_n$

⇩

SCANNING RANGE OF R.F. VOLTAGE: $M_1 \sim M_n$

- $V_1$ : AMPLITUDE OF R.F. VOLTAGE CORRESPONDING TO MASS-TO-CHANGE RATIO $M_1$
- $V_n$ : AMPLITUDE OF R.F. VOLTAGE CORRESPONDING TO MASS-TO-CHANGE RATIO $M_n$

FIG.23 *PRIOR ART*

■ : ANALYZING POINT OF RESOLUTION VS AMPLITUED RATIO (WHEN q = 0.404)

□ : ANALYZING POINT OF UNSTABLE PERIOD VS AMPLITUDE RATIO (WHEN q = 0.404)

FIG. 26 *PRIOR ART*
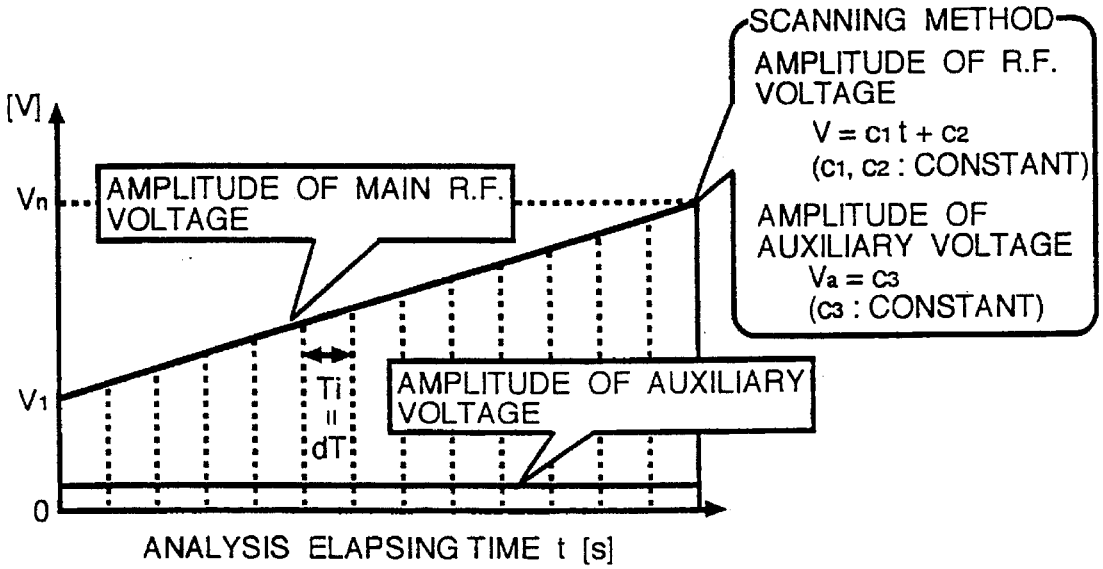
DETECTED RANGE IN MASS-TO-CHANGE RATIO: WHEN $M_1 \sim M_n$
⇩
SCANNING RANGE OF R.F. VOLTAGE: $M_1 \sim M_n$
$V_1$ : AMPLITUDE OF R.F. VOLTAGE CORRESPONDING TO MASS-TO-CHANGE RATIO $M_1$
$V_n$ : AMPLITUDE OF R.F. VOLTAGE CORRESPONDING TO MASS-TO-CHANGE RATIO $M_n$
$T_i = dT \ (i = 1 \sim n)$ ($T_i$ : i ANALYZING TIME ALLOCATED TO i-TH ION)

MASS SPECTROMETER RING-SHAPED ELECTRODE HAVING HIGH ION SELECTION EFFICIENCY AND MASS SPECTROMETRY METHOD THEREBY

BACKGROUND OF THE INVENTION

The present invention relates to a mass spectrometer and, more particularly, to a mass spectrometer suitable for a mass spectrometer of ion trap type.

As shown in FIG. 2, a mass spectrometer of ion trap type comprises a ring electrode 6 having a ring shape, two end-cap electrodes 7 and 8 arranged in the axial direction (z-axis) of the ring electrode 6 so as to sandwich the ring electrode 6. By applying a direct current voltage U and a radio frequency (R.F.) voltage V cos(Ωt) to each of these electrodes, a quadrupole electric field is formed in a volume among the electrodes. Stability of an ion trajectory in the quadrupole electric field is determined by an a-value and a q-value expressed by Equation 1.

$$a=8ZeU/(mr_0^2\Omega^2),\ q=4ZeV/(mr_0^2\Omega^2) \quad (1)$$

where e is the quantum of electricity, $r_0$ is the internal radius of the ring electrode 6, m is an ion mass, Z is an ionic charge number, Ω is an angular frequency of the radio frequency voltage, U is a direct current (DC) voltage and V is an amplitude of the radio frequency voltage.

FIG.3 shows a stability diagram expressing the range of a- and q-values which determine the stability of an ion trajectory inside the ion trap. A group of curves shown inside the stability region are iso-β lines of parameters, βr and βz, which define oscillation characteristics of ions in the r-direction (the radial direction of the ring electrode 6) and the z-direction (the axial direction of the ring electrode 6). The stability region corresponds to a region surrounded by the lines, βr=0, βr=1.0, βz=o and βz=1.0. Ions tracing a stable trajectory correspond to a point inside the stability region depending on an m/Z (mass-to-charge ratio) of the ions. Therefore, values βr and βz are determined corresponding to the m/Z.

The oscillating movement of an ion can be decomposed into components of r (radial) and z (axial) directions. The oscillation characteristics of the r- and z-directions are determined by the values of βr and βz, respectively. Fundamental angular frequencies βr and βz, known as secular angular frequencies, determining oscillation in the r- and z-directions are given by Equation 2.

$$\omega r=\Omega\beta r/2,\ \omega z=\Omega\beta z/2, \quad (2)$$

In a conventional resonance ejection method, as shown in FIG. 7, alternating voltages $\Delta\phi_1$ (=$V_0\cos(\omega z\ t)$ and $\Delta\phi_2$ (=$-\Delta\phi_1$) having the same angular frequency as the fundamental angular frequency of the oscillation in the z-direction is applied to the end cap electrodes 7 and 8. Since the pointing direction of the z-direction component of the auxiliary electric field $E_0$ generated between the end cap electrodes by the alternating current voltage is alternatingly changed, the ion trajectory becomes unstable equally to both the positive and negative sides of the z-direction. For example, in a case where a mass spectrometer is connected to a gas chromatograph, it is required to arrange an electron gun 5 for producing ions in the side of one end cap electrode 7 in order to ionize a sample in the volume surrounded by the three ion trap electrodes, and a detector 9 cannot be chosen but arranged in the side of the other end cap electrode 8, as shown in FIG. 2. In this case, since the ion trajectory becomes unstable to both of the positive and negative sides of the z-axis, ions unstabilized in the side of the electron gun 5 are not detected.

Examples of such conventional technologies are disclosed in Japanese Patent Application Laid-Open No. 1-258353 (1989) where ions are detected while the trajectory is unstabilized after one ion species is stably trapped, and both in Japanese Patent Application Laid-Open No. 63-313460 (1988) and Japanese Patent Application Laid-Open No. 2-103856 (1990) where ions are resonance ejected in the z-direction to identify the mass by applying an ion exciting voltage having an oscillation frequency equal to a secular frequency of trapped ions between end cap electrodes.

In the above conventional technologies, the detecting efficiency is low since ions unstabilized to the side of the electron gun cannot be detected though the ion trajectory is unstabilized to both the positive and negative sides of the z-axis (that is, the pointing directions in which the ions are unstabilized are the positive side and the negative side of the z-axis).

In addition to the above, the conventional mass scanning method requires a very long time to analyze a whole range of all ion species, and there is possibility to degrade the analyzing accuracy due to occurrence of displacement in mass spectrums (mass shift) when the ions are trapped inside an ion trap for a long time. In other words, with a conventional method shown in FIG. 13, an amplitude of a radio frequency voltage is linearly varied with time while a resonance voltage having a constant amplitude is applied throughout the whole scanning of mass-to-charge ratios within the interest range of $M_1$ to $M_n$. Therefore, in the conventional method, as the value of a mass-to-charge ratio increases, the amplitude ratio of an auxiliary voltage and a radio frequency voltage decreases, and consequently the higher a mass-to-charge ratio of ion becomes, the higher the mass resolution becomes. However, since the amplitude of radio frequency voltage is scanned linearly to time, analyzing time distributed to each ion species is nearly equal. Therefore, if the amplitude ratio of the auxiliary voltage to the radio frequency voltage is set to such a small value that an ion species having a high mass number can be analyzed with a target mass resolution, it is necessary to allocate an analyzing time period sufficient enough to unstabilize the ions having the high mass number to all ion species, which increases the total analyzing time. That is, a long analyzing time period is allocated even to an ion having a small mass number which requires a small ratio of an auxiliary voltage $V_a$ to a radio frequency voltage V and an unstabilizing time shorter than that required for a high mass number ion.

In the method described above, since the mass-to-charge ratios for interest ions are scanned at a constant speed, a constant time period is allocated to analyzing each ion species having different mass-to-charge ratios. Therefore, if the amplitude ratio of the auxiliary voltage to the radio frequency voltage is set to such a small value as to match with an ion species having a high mass-to-charge ratio and requiring a high resolution, it takes a very long time to unstabilize the trajectory for an interest ion species. That is, a constant very long analyzing time is allocated to analysis of each ion species. Further, in mass spectrometry of the above method, it requires a very long time to analyze all ion species within the range of interest masses, and particularly the amplitude ratio is set too high for an ion having a low mass-to-charge ratio and an unnecessary long time is spent even for analyzing an ion which can be unstabilized in a short time.

On the other hand, if ions are contained inside an ion trap for an unnecessary long time, the ions are subjected to collisions with a neutral gas or large interactions with the other ions. Therefore, there is possibility to degrade the analyzing accuracy due to occurrence of displacement in mass spectrums (mass shift).

SUMMARY OF THE INVENTION

The first object of the present invention is to provide a mass spectrometer and a mass spectrometry method which have a high detecting efficiency.

The second object of the present invention is to provide a mass spectrometer of ion trap type which can perform mass spectrometry with a high mass resolution necessary and sufficient enough throughout the whole range of mass-to-charge ratios of interest ions, with a high speed, and with a high analyzing accuracy.

In order to attain the above object, according to the present invention, when mass spectrometry is performed by using signals of a detector detecting interest ion species by unstabilizing trajectories of the interest ion species among a plurality of ion species stably trapped by a radio frequency electric field inside a given volume, the direction of unstabilizing the interest ion species is directed at the side existing the detector by applying an electric field having the main component in the direction pointing toward the detector to the interest ion species with a cycle capable of synchronizing with oscillation in the axial direction of the interest ion species.

It is preferable that by applying an electric field having a direction different from the direction pointing toward the detector to a second ion species other than the interest ion species, the direction in which a trajectory of the second ion species is directed in a direction different from the direction pointing toward the detector.

It is also preferable that by applying an electric field having a direction opposite to the direction pointing toward the detector to a second ion species having a mass-to-charge ratio near the mass-to-charge ratio of the interest ion species, the second ion species is suppressed to be unstabilized in the direction pointing toward the detector.

Further, in order to attain the second object, according to the present invention, mass spectrometry capable of attaining a target mass resolution can be performed rapidly by varying the amplitude ratio of the auxiliary voltage to the radio frequency voltage, mass selection time per each ion species or scanning speed of mass-to-charge ratio corresponding to necessary mass resolution or mass-to-charge ratio for each ion species.

In detail, the first means is characterized by a mass spectrometry method using a mass spectrometer comprising a ring-shaped ring electrode and two end cap electrodes arranged facing each other so as to sandwich the ring electrode, applying at least a radio frequency voltage between a direct current voltage and the radio frequency voltage from a main power supply between the ring electrode and the two end cap electrodes to form a quadrupole electric field in a volume surrounded by the electrodes, ejecting interest ion species from the volume surrounded by the electrodes by unstabilizing trajectories of the interest ion species among ions trapped in the quadrupole electric field by generating an auxiliary alternating current electric field, the ion species being ejected from the volume surrounded by the electrodes to be detected, in which the interest ion species are ejected by varying the amplitude ratio of an auxiliary alternating current voltage generating an auxiliary alternating current electric field by applying to the end cap electrodes to the radio frequency voltage corresponding to a mass resolution required for mass spectrometry of the interest ion species.

The second means is characterized by a mass spectrometry method described above in which each ion species having different mass-to-charge ratios is time-sequentially detected by scanning mass-to-charge ratio within the range of the mass-to-charge ratios of the interest ion species.

According to the present invention, the direction of unstabilizing the trajectories of the interest ion species so as to be directed toward the detector by applying an electric field having the main component in the direction pointing toward the detector to the interest ion species with a cycle capable of synchronizing with oscillation in the direction pointing toward the detector for the interest ion species. Therefore, almost all of the interest ion species can be certainly detected without loss and accordingly the detecting efficiency can be largely improved.

By applying an electric field having a direction different from the direction pointing toward the detector to a second ion species other than the interest ion species, the direction in which a trajectory of the second ion species is preferably directed in a direction different from the direction pointing toward the detector. Therefore, since an effect of space charge by the second ion species other than the interest ion species can be decreased, the mass shift caused by the effect can be decreased and the mass resolution can be improved.

Further, by applying an electric field having a direction opposite to the direction pointing toward the detector to a second ion species having a mass-to-charge ratio near the mass-to-charge ratio of the interest ion species, the second ion species is suppressed to be unstabilized in the direction pointing toward the detector. Therefore, error in measurement caused by the second ion species can be avoided.

As shown in FIG. 25, there is a relationship that the mass resolution is increased and on the other hand the time required for unstabilizing an ion trajectory is increased as the amplitude ratio of the auxiliary voltage to the radio frequency voltage is decreased. According to the present invention, based on this relationship, the amplitude of the auxiliary voltage is adjusted so as to become an amplitude ratio of the auxiliary voltage to the radio frequency voltage corresponding to a necessary mass resolution for each ion species, and with this magnitude of the auxiliary voltage the scanning speed of the amplitude of the radio frequency voltage is controlled so as to allocate analyzing time sufficient to unstabilize a trajectory of each ion species. Therefore, according to the present invention, since the amplitude ratio of the auxiliary voltage to the radio frequency voltage is set corresponding to a necessary mass resolution, analysis having a target mass resolution can be attained over the range of whole mass numbers. Further, in a case where the amplitude ratio of the auxiliary voltage to the radio frequency voltage is set so as to attain a target mass resolution, analyzing time allocated to each ion species is determined based on the unstabilizing time required for unstabilization (time required for unstabilizing a trajectory of each ion species). Therefore, unnecessary analyzing time can be omitted and the total analyzing time can be largely reduced.

BRIEF DESCRIPTION OF THE DRAWINGS

FIG. 1 is a schematic diagram showing a first embodiment of a mass spectrometer of ion trap type in accordance with the present invention.

FIG. 2A, FIG. 2B and FIG. 2C are cross sectional views showing mass spectrometers of ion trap type which the present invention is applied to.

FIG. 3 is an explanatory graph showing the stability region inside an ion trap.

FIG. 7 is a chart showing an auxiliary voltage used in a conventional resonance ejection method.

FIG. 8 is a chart showing an auxiliary voltage used in a fourth resonance ejection method in accordance with the present invention.

FIG. 12 ia a graph showing a time-varying characteristic of an amplitude of a main radio frequency voltage used in the fourth resonance ejection method in accordance with the present invention.

FIG. 13 ia a graph showing a time-varying characteristic of an amplitude of a main radio frequency voltage used in the fourth resonance ejection method in accordance with the present invention.

FIG. 26 is an explanatory graph showing a scanning method of a radio frequency voltage and an auxiliary voltage in a conventional example of a mass spectrometer of ion trap type.

DETAILED DESCRIPTION OF THE PREFERRED EMBODIMENTS

Figure 2B:
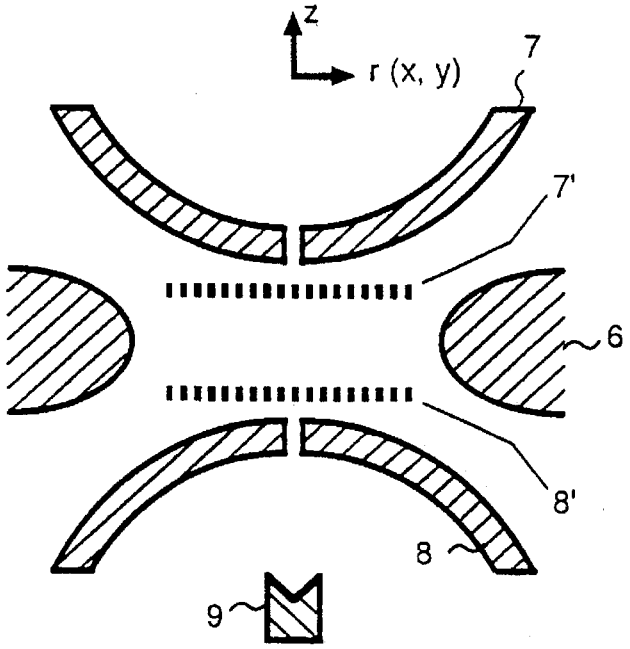
FIG. 2B PRIOR ART

Embodiments of the present invention will be described below, referring to the accompanying drawings.

FIG. 1 is a schematic diagram showing a first embodiment of a mass spectrometer of ion trap type in accordance with the present invention. The mass spectrometer comprises an ion trap for forming a volume to trap produced ions, a sample introducing means 2 for supplying a sample in the ion trap, an electron gun 5 for producing the ions, a detector 5 for detecting the ions, a power supply for applying voltage to the ion trap, a control means 3 for controlling the power supply and the electron gun 5, a mass analyzing means 10 for performing mass spectrometry based on a detected signal of the detector 9.

The ion trap is composed of a ring-shaped ring electrode 6 and two end cap electrodes 7 and 8 arranged in the axial direction of the ring electrode 6 so as to sandwich the ring electrode 6. A sample of mass analyzed object supplied to the volume between the electrodes from a sample source 1 through the sample introducing means 2 is ionized by colliding with electrons supplied from the electron gun 5 though an aperture 12 in the end cap electrode 7.

By applying a radio frequency voltage $V\cos(\Omega t)$ from a main power supply 4 to the ring electrode 6, a quadrupole electric field is produced in the volume between the electrodes. Stability of a trajectory of ions having mass m and ionic charge number Z depends on whether or not a characteristic point (q, a) determined by an a-value and a q-value defined by Equation 1 exists inside the stability region shown in FIG. 3. That is, in a case where the characteristic point (q, a) exists inside the stability region, the ions are stably oscillated inside the volume between the electrodes. On the other hand, in a case where the characteristic point (q, a) exists outside the stability region, the trajectory of the ions becomes unstable, the amplitude of oscillation is increased, and the ions are ejected from the volume between the electrodes.

The control means 3 controls voltage supplied to the electrode from the main power supply 4 based on the range of mass-to-charge ratio of ion species to be analyzed. By gradually increasing the amplitude of radio frequency voltage applied to the electrodes after trapping all ion species in the range of mass-to-charge ratios to be analyzed inside the ion trap, the mass-to-charge ratio of ions ejected from a resonance ejection point (a point where ions are ejected by resonance phenomenon) inside the stability region or from a normal ejection point (a point where ions are ejected not by resonance phenomenon) inside the stability region increases. That is, instability gradually shifts from a low mass ion trajectory to a high mass ion trajectory, and correspondingly ejected ions shifts from low mass to high mass from the volume between the electrodes through the apertures 12, 13 in the end cap electrodes. Only the ions ejected through the aperture 13 are detected by the detector 9 to be analyzed by the mass analyzing means 10. In such a way, the mass-selective scanning is performed by varying the amplitude of the radio frequency voltage supplied to the electrodes. Therein, the control means 3 controls the whole process of mass-selection, that is, ionization of the sample, mass-selective scan, ion detection and mass spectrometry.

Figure 4:
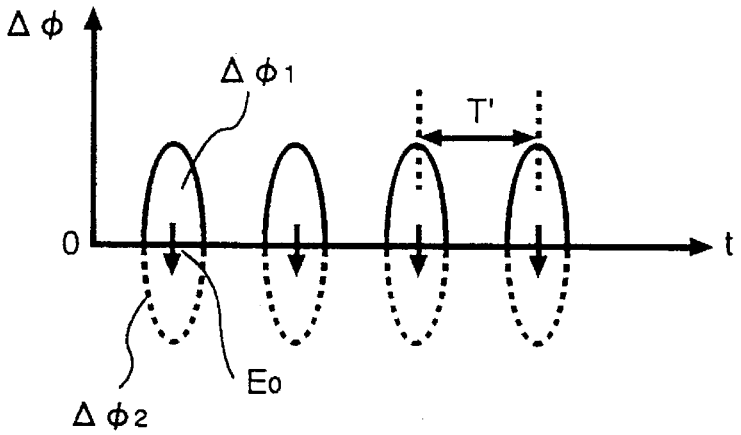
FIG. 4 is a chart showing an auxiliary voltage used in a first resonance ejection method in accordance with the present invention.

A first embodiment of a resonance ejection method according to the present invention used in this embodiment will be described below. Oscillation characteristic in the z-direction (the axial direction of the ring electrode 6) of ions stably trapped in the ion trap is different depending on the mass-to-charge ratio of the ion species. By applying auxiliary voltages $\Delta\phi_1$ and $\Delta\phi_2$ to the end cap electrodes 7 and 8 from the auxiliary power supply 11 as shown in FIG. 4, the direction of the auxiliary electric field $E_0$ generated between the end cap electrodes is made to point only toward the detector 9. In this occasion, by setting the cycle of the auxiliary voltage near the oscillation cycle T' ($=2\pi/\omega z$) in the z-direction of an interest ion species, the interest ion species is synchronized with the auxiliary electric field $E_0$ so as to be certainly unstabilized in the side of the detector.

Table 1 shows analytical results of unstabilization ratios of an ion trajectory in the detector side and in the electron gun side for the resonance ejection method according to the present invention shown in FIG. 4 and the conventional resonance ejection method shown in FIG. 7. The analytical results in Table 1 are average values of instability ratios in each side which are obtained through a numerical analysis by varying initial phase difference between a main radio frequency voltage and an auxiliary voltage under a condition where the auxiliary voltage has an amplitude of 1% as large as the amplitude of the main radio frequency voltage $V\cdot\cos(\Omega t)$ supplied from a main power supply 4, and has an angular frequency $\omega z$ ($=\Omega\beta z/2$) of which the resonance ejection point corresponds to $\beta z=0.2957$ in the stabile region of FIG. 3. However, in this numerical analysis, it is not considered that the interest ion species are interacted with neutral gas and the other ion species.

TABLE 1

| | ELECTRON GUN SIDE | DETECTOR SIDE |
|---|---|---|
| CONVENTIONAL RESONANCE EJECTION METHOD | 50.0% | 50.0% |
| THE FIRST RESONANCE EJECTION METHOD OF THE PRESENT INVENTION | 7.45% | 92.55% |

As shown in Table 1, in the conventional resonance ejection method, the interest ions are ejected equally toward both the detector side and the electron gun side. On the other hand, in the resonance ejection method in accordance with the present invention, most of the interest ions are certainly ejected toward the detector side. Therefore, in this case, the resonance election method of the present embodiment can obtain nearly twice as high detecting sensitivity as the conventional resonance ejection method. Further, this method is effective in a case where number of ions is very small since the S/N ratio increases as a result.

Although in this embodiment an electric field having only a component pointing toward the detector side is employed as the auxiliary electric field $E_0$, it is sufficient to employ an electric field having a main component pointing toward the detector as the auxiliary electric field $E_0$. In such a case, it is also possible to improve its detecting sensitivity.

Further, as for the auxiliary voltage applied to the end cap electrode, it may be possible to ground the end cap electrode 7 and apply $\Delta\phi_2$ in FIG. 4 to the end cap electrode 8, or to ground the end cap electrode 8 and apply $\Delta\phi_1$ in FIG. 4 to the end cap electrode 7. It may be also possible that the cycle of the auxiliary voltage is ½n (n is an integer) times of the oscillation cycle of the interest ion species. Furthermore, although in this embodiment the voltage from the main power supply 4 is applied to the ring electrode 6, it may be possible that the voltage from the main power supply 4 is applied to the end cap electrode. In such a case, it is also possible to attain the same effect.

Figure 5A:
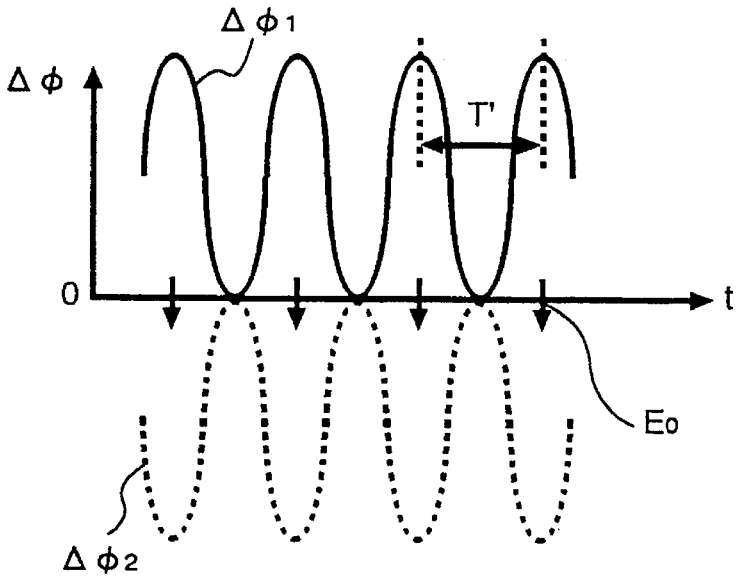
FIG. 5A and FIG. 5B are charts showing auxiliary voltages used in a second resonance ejection method in accordance with the present invention.
Figure 5B:
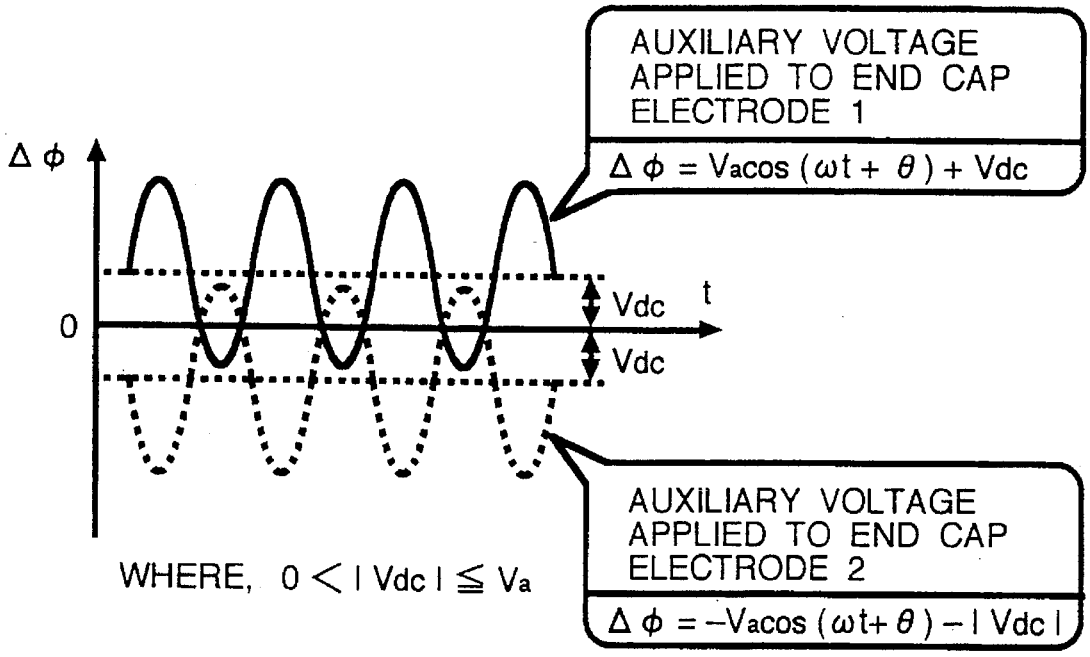

A second embodiment of a resonance ejection method according to the present invention used in this embodiment will be described below, referring to FIG. 5. In this resonance ejection method, an auxiliary voltage $\Delta\phi_1$, which is formed by superposing a direct current voltage $V_0$ to the voltage shown in FIG. 7, is applied to the end cap electrode 7 and an auxiliary voltage $\Delta\phi_2$, which is formed by superposing a direct current voltage $-V_0$ to the voltage shown in FIG. 7, is applied to the end cap electrode 8. Since in this resonance ejection method, as the first embodiment of the resonance ejection method, the direction of the auxiliary electric field $E_0$ generated between the end cap electrodes can be made to point only toward the detector side, ion trajectories can be unstabilized pointing only toward the detector side.

The auxiliary voltage in this resonance ejection method has an oscillation mode which is closer the oscillation mode in the z-direction of the interest ion species compared to in the first embodiment of the resonance ejection method. Therefore, the other ion species are less affected and accordingly this resonance method can detect the interest ion species with a higher mass resolution. It may be also possible that the cycle of the auxiliary voltage is ½n (n is an integer) times of the oscillation cycle of the interest ion species. In this resonance ejection method, it may be also possible to ground any one of the end cap electrodes 7 and 8. In this case, since the auxiliary electric field pointing toward the detector side becomes stronger than the auxiliary electric field pointing toward the electron gun side though the auxiliary electric field pointing toward the electron gun side is generated, the ion detection efficient can be improved compared to the conventional resonance ejection method.

Figure 6:
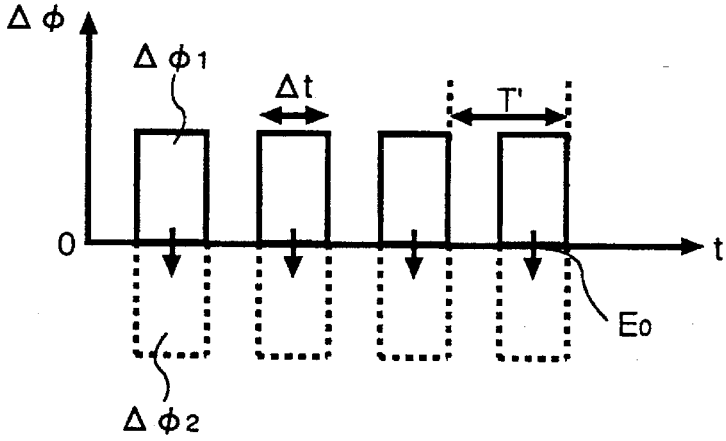
FIG. 6 is a chart showing an auxiliary voltage used in a third resonance ejection method in accordance with the present invention.

A third embodiment of a resonance ejection method according to the present invention used in this embodiment will be described below, referring to FIG. 6. In this resonance ejection method, a pulse voltage having a rectangular wave form is used as the auxiliary voltage. In this case, an auxiliary voltage $\Delta\phi_1$ shown in FIG. 6 is applied to the end cap electrode 7 and an auxiliary voltage $\Delta\phi_2$ is applied to the end cap electrode 8. Since in this resonance ejection method, as the first embodiment of the resonance ejection method, the direction of the auxiliary electric field $E_0$ generated between the end cap electrodes can be made to point only toward the detector side, ion trajectories can be unstabilized pointing only toward the detector side. Further, by holding the cycle T' of the auxiliary voltage nearly coincident with the oscillation cycle in the z-direction of the interest ion species and lessening the pulse width $\Delta t$ of the auxiliary voltage as small as possible, the other ion species are less affected and accordingly this resonance method can detect the interest ion species with a higher mass resolution.

Table 2 shows analytical results of unstabilization ratios of an ion trajectory in the detector side and in the electron gun side for the second embodiment of the resonance ejection method shown in FIG. 5, the third embodiment of the resonance ejection method shown in FIG. 6 and the conventional resonance ejection method shown in FIG. 7 obtained under the same analytical condition as that of Table 1. As shown in Table 2, in both of the second embodiment of the conventional resonance ejection method and the third embodiment of the conventional resonance ejection method, most of the interest ions can be ejected certainly toward the detector side. Therefore, in this case, the resonance election methods of the present embodiments can obtain nearly twice as high detecting sensitivity as the conventional resonance ejection method.

TABLE 2

| | ELECTRON GUN SIDE | DETECTOR SIDE |
|---|---|---|
| CONVENTIONAL RESONANCE EJECTION METHOD | 50.0% | 50.0% |
| THE SECOND RESONANCE EJECTION METHOD OF THE PRESENT INVENTION | 1.38% | 98.62% |
| THE THIRD RESONANCE EJECTION METHOD OF THE PRESENT INVENTION | 2.9% | 97.1% |

A fourth embodiment of a resonance ejection method according to the present invention will be described below. In this resonance ejection method, before detecting interest ion species, the other ion species (unwanted ions) except the interest ion species are removed from the volume between the end cap electrodes by unstabilizing the trajectories of the unwanted ions in the direction pointing toward the electron gun side. For doing so, an auxiliary voltage which is one of the auxiliary voltage used in the first embodiment of the resonance ejection method to the third embodiment of the resonance ejection method but has the reversed polarity can be utilized as the auxiliary voltage applied to the end cap electrodes 7 and 8. For example, in order to generate an auxiliary electric field $E_1$ so that the z-component points toward the electron gun side by reversing the polarity of the auxiliary voltage shown in FIG. 4, auxiliary voltages $\Delta\phi_1$ and $\Delta\phi_2$ shown in FIG. 8 are applied to the end cap electrodes 7 and 8. By doing so, after removing the unwanted ions through between the end cap electrode, the interest ion species are mass selected by any one of the first to the third embodiments of the resonance ejection methods, the ion ejection method by shifting a characteristic point outside the stable region as shown in FIG. 3 (normal ejection method) and the conventional resonance ejection method. Therein, the normal ejection and the unwanted ion removing can be performed at the same instant. In another way, by alternatingly applying an auxiliary voltage pointing toward the detector side and an auxiliary voltage pointing toward the electron gun side, detection of the interest ion species (unstabilization in the direction toward the detector side) and removal of the unwanted ion species (unstabilization in the direction toward the electron gun side) may be alternatingly time-shifted during a series of processes of mass-selection for ion analysis. For example, in a case of time-continuously scanning the mass of ion species for mass spectrometry (interest ion species) as shown in FIG. 12, an auxiliary electric field in the direction pointing toward the detector side is applied during time $\Delta t_1$ in the time until next ion species is mass-selected ($\Delta T$) and an electric field in the direction pointing toward the electron gun side is applied during the remaining time $\Delta t_2$ ($=\Delta T-\Delta t_1$). By doing so, the interest ion species can be mass-selected during $\Delta t_1$ and the unwanted ion species can be removed during $\Delta t_2$.

Figure 14:
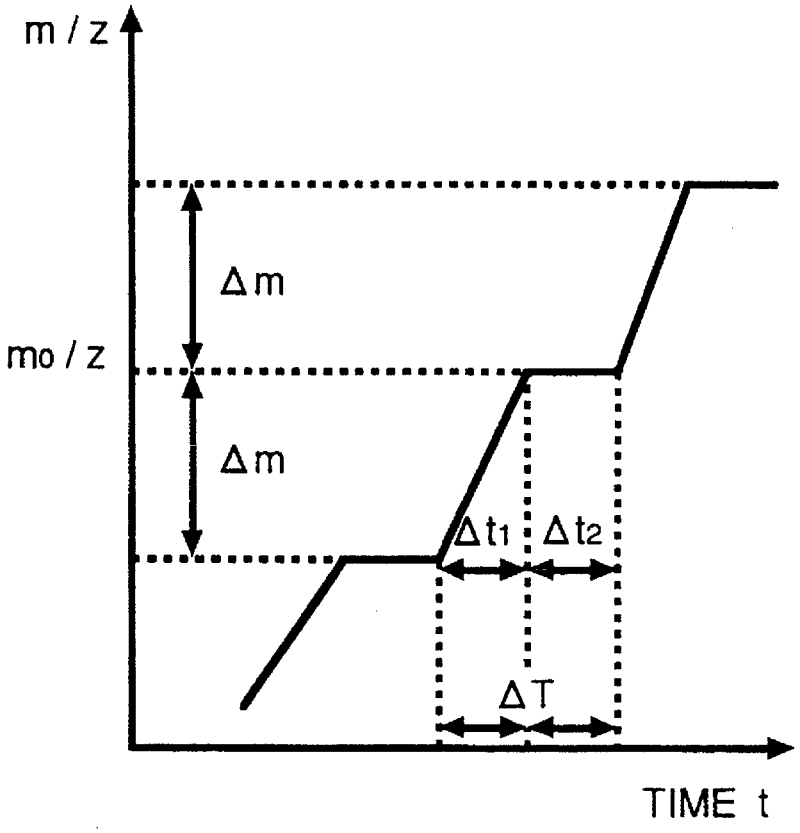
FIG. 14 ia a graph showing a time-varying characteristic of an amplitude of a main radio frequency voltage used in the fourth resonance ejection method in accordance with the present invention.

In a method of scanning mass in step-shape every time period of $\Delta T$ ($=\Delta t_1+\Delta t_2$) as shown in FIG. 13, or in a method of continuously mass-scanning during $\Delta t_1$ and stopping mass-scanning for a time $\Delta t_2$ to remove unwanted ions as shown in FIG. 14, detection of the interest ion species and removal of the unwanted ion species can be alternatingly performed by switching the auxiliary electric field according to $\Delta t_1$ and $\Delta t_2$.

The mass-scanning for mass spectrometry as shown in FIG. 12 to FIG. 14 is performed by gradually varying a quadrupole electric field. That is, the mass-scanning is performed by a method of gradually varying the amplitude of a main radio frequency voltage, or the frequency of a main radio frequency voltage, or both of a direct current voltage and a radio frequency voltage.

In a case where mass of interest ion species is increased as time passes as shown in FIG. 12 to FIG. 14, the unwanted ions are ions having mass-to-charge ratios smaller than that of the interest ion species, ions remaining inside an ion trap by slipping away the ejection timing or ions beyond the range of the mass spectrometry. In a case where mass of interest ion species is decreased as time passes, the unwanted ions are ions having mass-to-charge ratios larger than that of the interest ion species, ions remaining inside an ion trap by slipping away the ejection timing or ions beyond the range of the mass spectrometry.

By applying an electric field pointing toward the electron gun side having a frequency corresponding to the unwanted ion, the unwanted ions can be effectively removed. Therefore, it is possible to avoid an error measurement due to ions slipping away the ejection timing and to decrease effect of space charge due to ions beyond the range of the mass spectrometry, and to improve the mass resolution.

A lot of ions are trapped between the end cap electrodes, motion of the ions is strongly affected by the space charge due to the other ions to cause a mass shift (displacement in mass spectrum). In order to solve this problem, number of ions trapped between the electrodes is decreased by removing the unwanted ions from the electrodes as in the present resonance ejection method. Therefore, the interest ion species can be less affected from the other ions, the mass shift is suppressed and the mass resolution can be improved.

A second and third embodiments of mass spectrometers according to the present invention will be described below, referring to FIG. 9 and FIG. 10. The embodiments are tandem type mass spectrometers in which a plurality of mass spectrometers are connected. In a case where ion species having a very wide range of mass-to-charge ratio are analyzed at a time, for example, two mass spectrometers having different sizes are combined and share mass analyzing depending on the magnitude of mass-to-charge ratio of ions. Therein, there are two cases, one is a case where a small sized ion trap is arranged in the latter stage of a large sized mass spectrometer as shown in FIG. 9 and the other is a case where a large sized ion trap is arranged in the latter stage of a small sized mass spectrometer as shown in FIG. 10.

Figure 9:
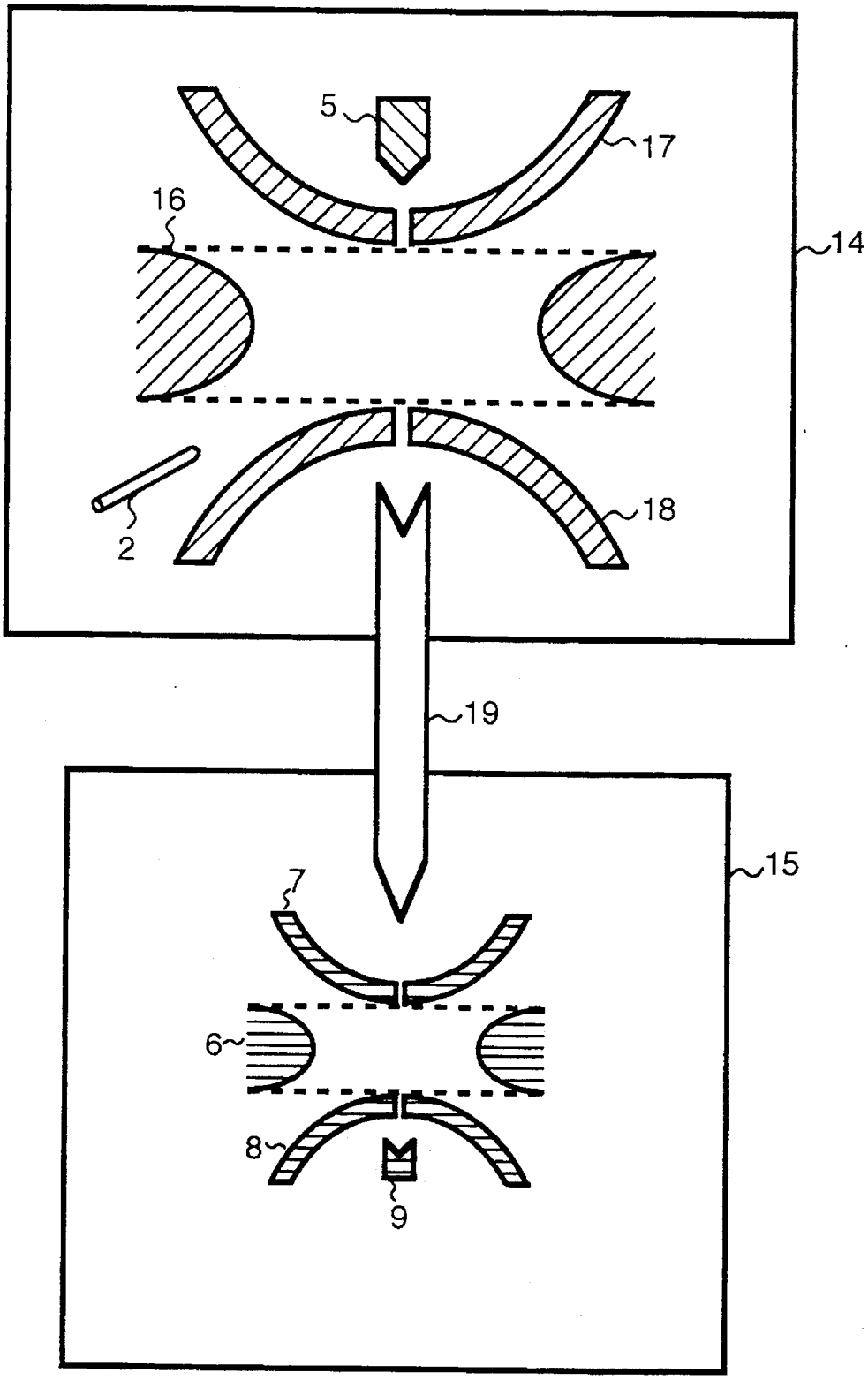
FIG. 9 is a schematic view showing a second embodiment of a mass spectrometer of ion trap type in accordance with the present invention.
Figure 9:
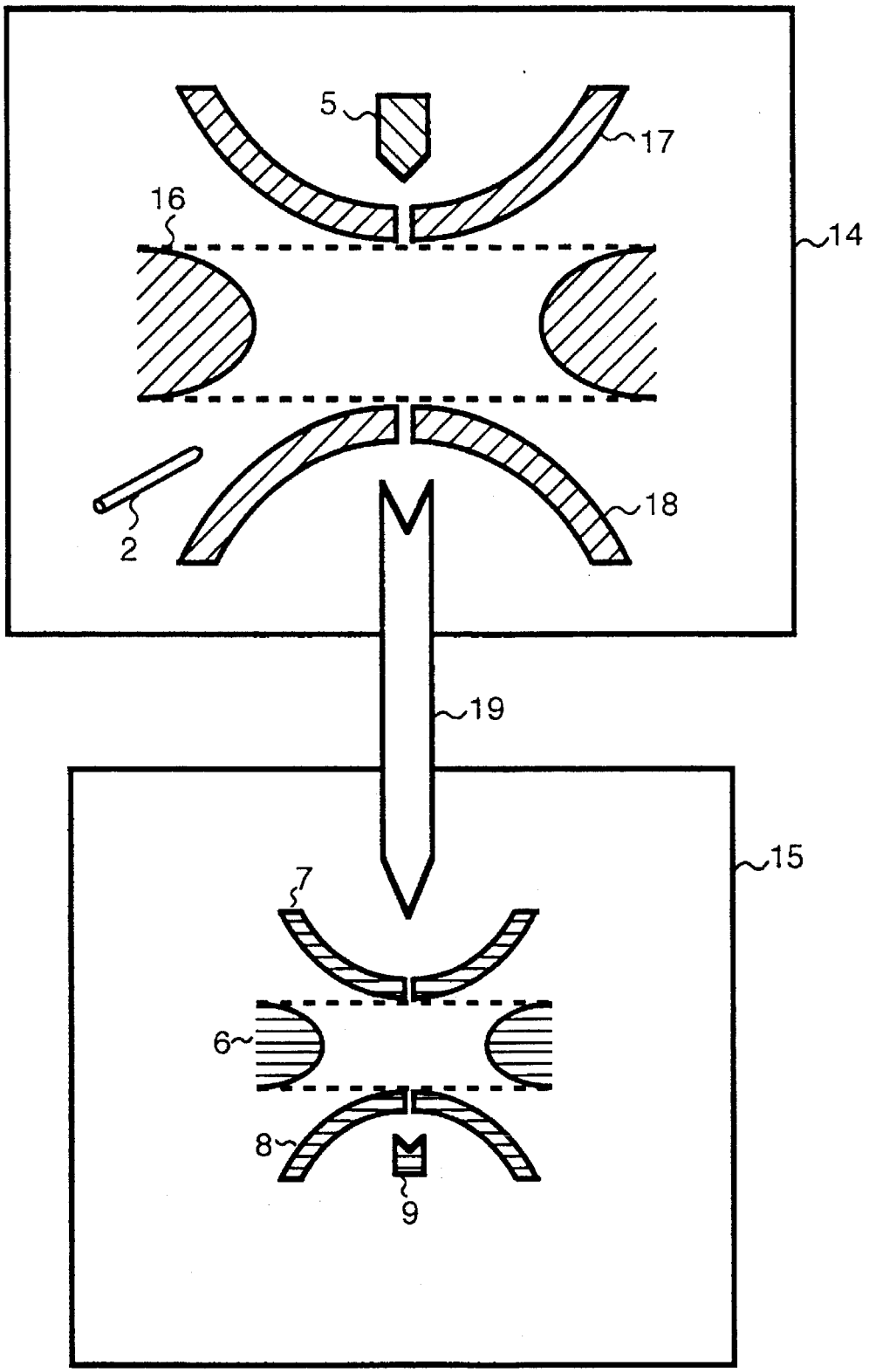

In a case of FIG. 9, initially ion species in as a wide range of mass-to-charge ratio as possible are trapped in a first large-sized ion trap 14, and all ion species having mass-to-charge ratios larger than a pre-determined value are ejected from the first ion trap 14 to be injected into a second small-sized ion trap 15, and there the ion species having large mass-to-charge ratios are dedicatedly mass-analyzed. In the first ion trap, the ion species having mass-to-charge ratio smaller than the per-determined value are dedicatedly mass-analyzed. Therein, by applying the above-mentioned resonance ejection method according to the present invention to the first ion trap 14, ions are ejected from the first ion trap 14 in the direction pointing only toward the second ion trap 15. Therefore, the ions are injected into the second ion trap 15 through an ion transfer portion 19 without loss, and consequently loss in number of ions can be avoided.

Figure 10:
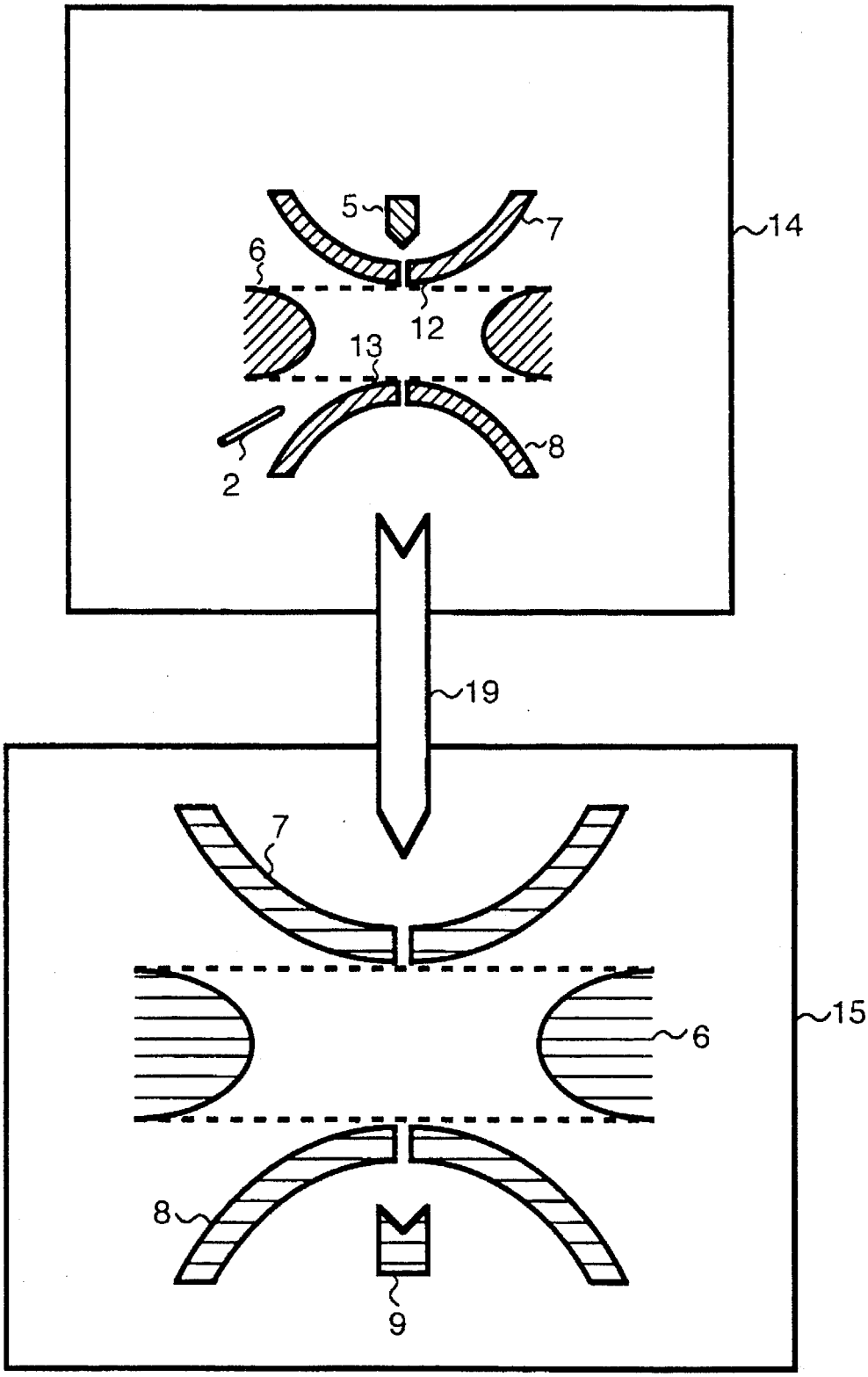
FIG. 10 is a schematic view showing a third embodiment of a mass spectrometer of ion trap type in accordance with the present invention.

In a case of FIG. 10, initially ion species in as a wide range of mass-to-charge ratio as possible are trapped in a first large-sized ion trap 14, and all ion species having mass-to-charge ratios smaller than a pre-determined value are ejected from the first ion trap 14 to be injected into a second small-sized ion trap 15, and there the ion species having small mass-to-charge ratios are dedicatedly mass-analyzed. In the first ion trap, the ion species having mass-to-charge ratio larger than the per-determined value are dedicatedly mass-analyzed. However, in the cases of FIG. 9 and FIG. 10, when the ions injected into the second ion trap 15 have a high kinetic energy, a neutral gas is injected into the ion trap 15 (not shown) to decrease the ion energy by collision with the neutral gas.

For mass spectrometry of the same range of mass-to-charge ratio, the mass spectrometry using such a mass spectrometer combining a plurality of ion traps having different sizes can be performed in higher accuracy, higher mass resolution and higher speed than a mass spectrometry using only one ion trap. Further, by ejecting ions from the first ion trap in the direction only toward the second ion trap, ions are injected into the second ion trap without loss and consequently it is possible to obtain a high detection-sensitive mass spectrum.

Figure 11:
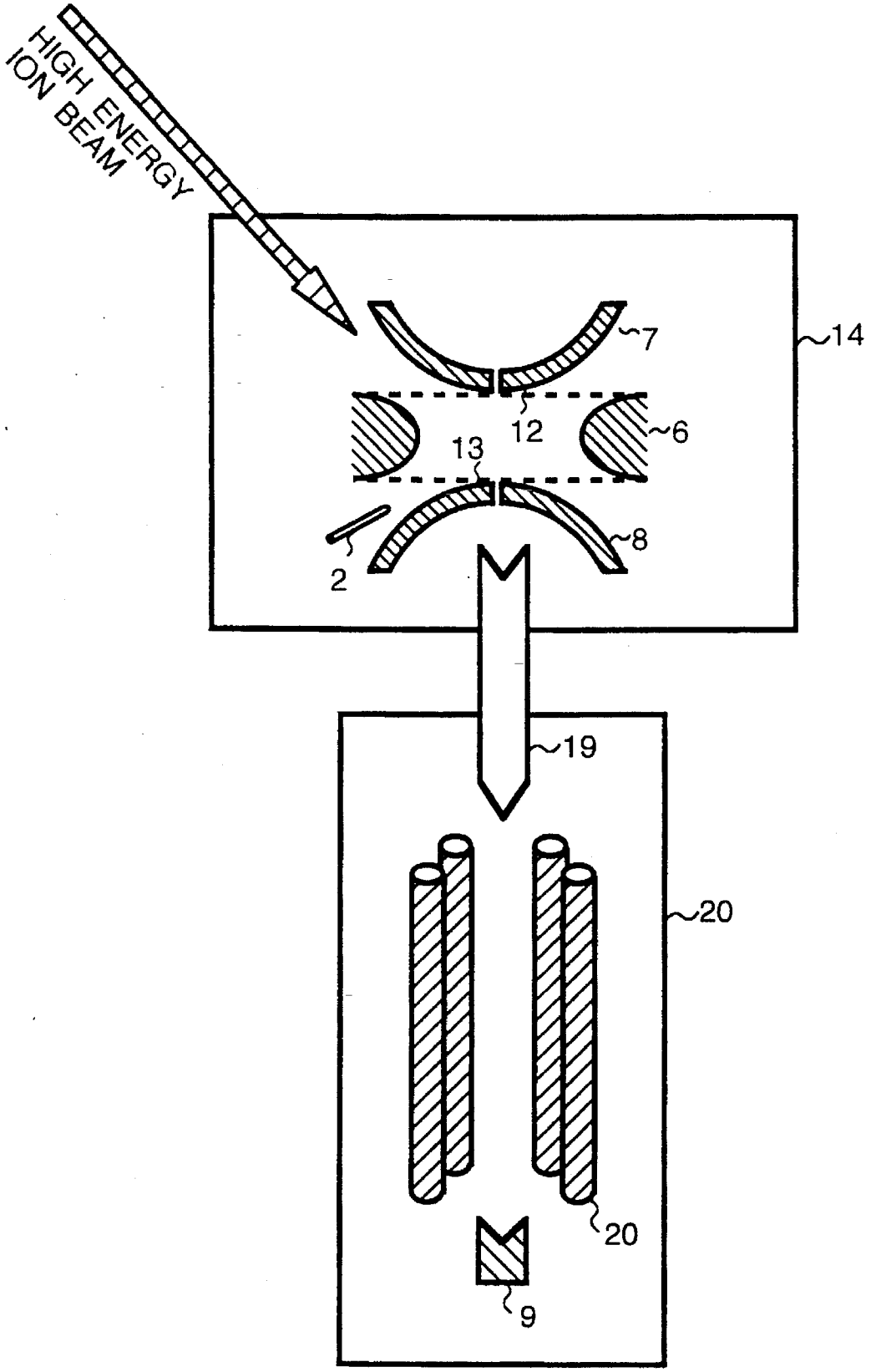
FIG. 11 is a schematic view showing a fourth embodiment of a mass spectrometer of ion trap type in accordance with the present invention.

A fourth embodiment of a mass spectrometers according to the present invention will be described below, referring to FIG. 11. The embodiment is an example where a quadrupole mass analyzer (QMS) 20 is arranged in the latter stage of an ion trap 14. In order to mass-analyze ions having a very high energy using the quadrupole mass analyzer 20, the energy of ions stably oscillating inside the ion trap 14 is decreased by being collided with a neutral gas. The ions decreasing their energy inside the ion trap 14 are ejected in the direction pointing toward the quadrupole mass analyzer 20 serving mass analysis. By applying the above-mentioned resonance ejection method according to the present invention to the ion trap 14, ions are ejected in the direction pointing only toward the quadrupole mass analyzer 20. Therefore, the ions are injected into the quadrupole mass analyzer 20 without loss and consequently it is possible to obtain mass spectrum having a high S/N ratio.

Figure 2C:
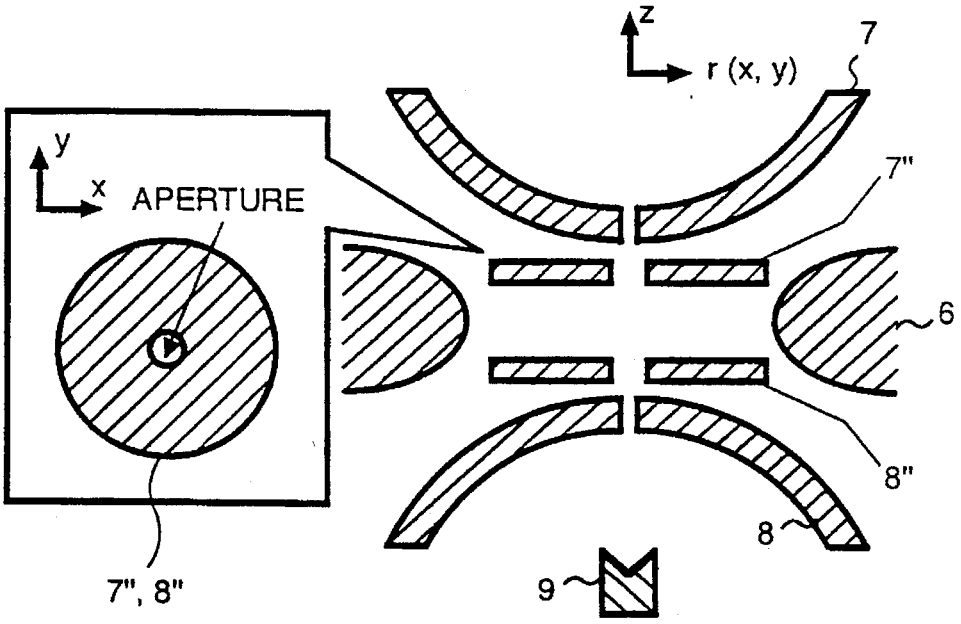
FIG. 2C PRIOR ART

A fifth embodiment of a mass spectrometer of ion trap type according to the present invention will be described below, referring to FIG. 2B and FIG. 2C. This embodiment is characterized by that the resonance voltage shown in FIG. 4, FIG. 5A, FIG. 5B or FIG. 6 is applied not to the end cap electrodes but applied to auxiliary electrodes 7', 8', 7", 8" shown in FIG. 2B and FIG. 2C. Since the pairs of auxiliary electrodes 7' and 8', 7" and 8" shown in FIG. 2B and FIG. 2C are parallel plates respectively, the resonance electric field generated among the electrodes does not depend on the coordinate when electric potential is applied to the electrodes. Therefore, ions are subjected the same electric field and sufficiently resonated to be ejected wherever in the ion trap the ions are placed. In FIG. 2B and FIG. 2C, the auxiliary electrodes are placed between ion trap electrodes. In a case where the auxiliary electrodes are placed between the ion trap electrodes as shown in FIG. 2B or FIG. 2C, it is thought that ions and electrons collide with the auxiliary electrodes and their motions are disturbed. In particular, since there is a high possibility that the electrons entering from an electron gun to ionize a sample and the ions ejected from the ion trap collide on the auxiliary electrodes, the place having the highest collision probability is on the center axis (z-axis) and its vicinity. In order to prevent such an interference with the motion of ions or electrons, in FIG. 2B the auxiliary electrodes 7' and 8' themselves are formed in mesh electrodes, and in the auxiliary electrodes of FIG. 2C 7" and 8" apertures are provided near the points crossing with the central axis (z-axis) of the ion trap.

In a case of providing the auxiliary electrodes as in FIG. 2B and FIG. 2C, Table 3 shows combination of auxiliary voltages (auxiliary alternating current voltage $V_0 \cos(\omega t+\theta)$ and direct current voltage $V_{dc}$) applied to the auxiliary electrodes. In Case 1 and Case 2, application of the auxiliary alternating current voltage $V_0 \cos(\omega t+\theta)$ and the direct current voltage $V_{dc}$ are shared with the auxiliary electrodes and the end cap electrodes, respectively. In Case 3, the auxiliary alternating current voltage $V_0 \cos(\omega t+\theta)$ and the direct current voltage $V_{dc}$ are applied to only the auxiliary electrodes and the auxiliary voltage is not applied to the end cap electrodes. In the all Cases, the same resonance electric field is generated among the ion trap electrodes and the obtained performances are also the same. Therefore, selection of the Case of combination can be determined by the limitation in the hardware structure. Further, the absolute magnitude of the direct current voltage $V_{dc}$ should be smaller than the amplitude $V_0$ of the auxiliary alternating current voltage. The signs of voltages shown in Table 3 indicate a case where positive ions are ejected in the direction pointing toward the detector side and negative ions are ejected in the direction pointing toward the electron gun side. For a case where positive ions are ejected in the direction pointing toward the electron gun side and negative ions are ejected in the direction pointing toward the detector side, the signs in Table 3 are reversed.

TABLE 3

| | CASE 1 | CASE 2 | CASE 3 |
|---|---|---|---|
| END CAP ELECTRODE 7 | $+V_0\cos(\omega t+\Theta)$ | $+V_{dc}$ | 0 |
| END CAP ELECTRODE 8 | $-V_0\cos(\omega t+\Theta)$ | $-V_{dc}$ | 0 |
| AUXILIARY ELECTRODE S 7', 8" | $+V_{dc}$ | $+V_0\cos(\omega t+\Theta)$ | $+(V_0\cos(\omega t+\Theta)+V_{dc})$ |
| AUXILIARY ELECTRODE S 7", 8" | $-V_{dc}$ | $-V_0\cos(\omega t+\Theta)$ | $-(V_0\cos(\omega t+\Theta)+V_{dc})$ |

($0 < V_{dc} \leqq V_0$, $\Theta$: phase difference to the main R.F. voltage)

other embodiments of the present invention to attain the second object of the present invention will be described below, referring to the accompanied figures.

[Embodiment 1]

Figure 21:
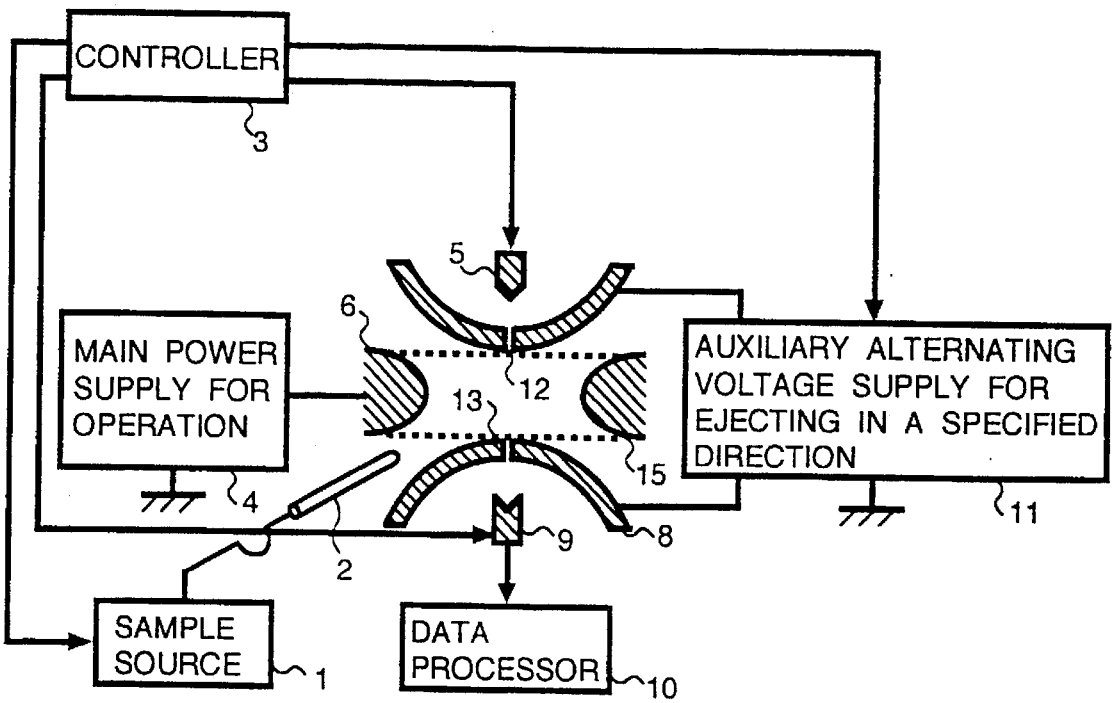
FIG. 21 is a schematic diagram showing a seventh embodiment of a mass spectrometer of ion trap type in accordance with the present invention.

Initially, a first embodiment will be described. FIG. 21 is a schematic diagram showing the overall construction of the first embodiment of a mass spectrometer of ion trap type according to the present invention which can attain the second object of the present invention.

An ion trap comprises, as described above, a ring electrode 6, and two, upper and lower, end cap electrodes 7 and 8 arranged in facing each other and sandwich the ring electrode, and a sample is supplied into a volume 15 between the electrodes from a sample source 1 through a sample introducing portion 2. A radio frequency voltage is supplied from a main power source 4 for operation to the ring electrode 6, and an auxiliary alternating current voltage is supplied from an auxiliary alternating current power source 11 to the end cap electrodes 7, 8. These power sources 4, 11 are controlled by a controller 3. The controller 3 controls an electron gun 5 arranged in the upper center of the end cap electrode 7, a detector arranged in the lower center of the end cap electrode 8 and a sample source 1 as well as these power source 4, 11. Further, a data processor 10 for processing data detected by the detector 9 is provided.

In the trap constructed as described above, a sample to be mass-analyzed injected into the volume 15 between the electrodes though the sample introducing portion 2 collides with electrons incident from the electron gun 5 for ionization through a center aperture 12 of the end cap electrode 7 to be ionized. Ions fly in a quadrupole electric field generated in the volume 15 between the electrodes by a direct current voltage U and a radio frequency voltage V cosΩt supplied between the end cap electrodes 7 and 8 and the ring electrode 6 from the main power source 4 for operation. Whether the trajectory of the flying ions having a mass-to-charge ratio (m/Z) is stable or unstable is determined by whether the characteristic point (a, q) of the ion is in the stable region S or in the unstable region IS of FIG. 24. Here, a stable state means a state that the amplitude of ion trajectory oscillation does not exceed a certain value and ions are oscillated inside the volume between the electrodes. On the other hand, an unstable state means a state that the amplitude of ion trajectory oscillation increases and ions are ejected from the volume between the electrodes. The values a and q are expressed by aforementioned Equation (1).

The voltage applied to the electrodes from the main power source 4 for operation is determined with the controller 3 by the size of the ion trap the frequency of the radio frequency voltage based on the range of ion mass number to be analyzed (mass-to-charge ratio m/Z). In this embodiment, as to the voltage for operation, the radio frequency voltage is applied but the direct current voltage is not applied. This condition corresponds to the straight line a=0 in the stability diagram of FIG. 24, and the all ion species corresponding to the characteristic points on the straight line a=0 inside the stable region S are stably trapped. It can be understood from Equation (1) that when mass number if ion (mass-to-charge ratio) is different, the q-value is different. By utilizing this fact, ideally, auxiliary voltages resonating only ion species having mass numbers corresponding to the q-values (resonance ejection points) within the following range expressed by Equation (3) is applied in order to perform mass-selection through resonance ejection.

$$0 \leqq q \leqq 0.908 \quad (3)$$

However, in practice, auxiliary voltage having frequencies f ($0 \leqq f \leqq \Omega$) is applied in order to perform mass-selection.

As the frequency of the radio frequency voltage is gradually increased once the all ion species within an interest range of mass numbers are trapped, the ion mass number (mass-to-charge ratio m/Z) corresponding to a q-point (resonance ejection point) inside the stable region is increased. Therefore, instability gradually shifts from a trajectory of ion species having a smaller mass number to a trajectory of ion species having a lager mass number, the unstabilized ion species is ejected from the volume 15 through the center aperture 12 and the aperture 13 in the detector side. Only the ions ejected from the volume 15 between the electrodes through the aperture 13 in the detector side are detected by the detector 9 to be processed by the data processor 10. That is, the ion species are mass-selected time-sequentially from an ion species having a smaller mass-to-charge ratio to an ion species having a larger mass-to-charge ratio by scanning so as to gradually increase the amplitude of the radio frequency voltage. Therein, the controller 3 controls a series of processes of mass-selection, that is, all of ionization of the sample, adjustment of the amplitude ratio of the resonance voltage to the radio frequency voltage, the mass-scanning speed, detection, and data processing. Resonance ejection will be described below.

Figure 24:
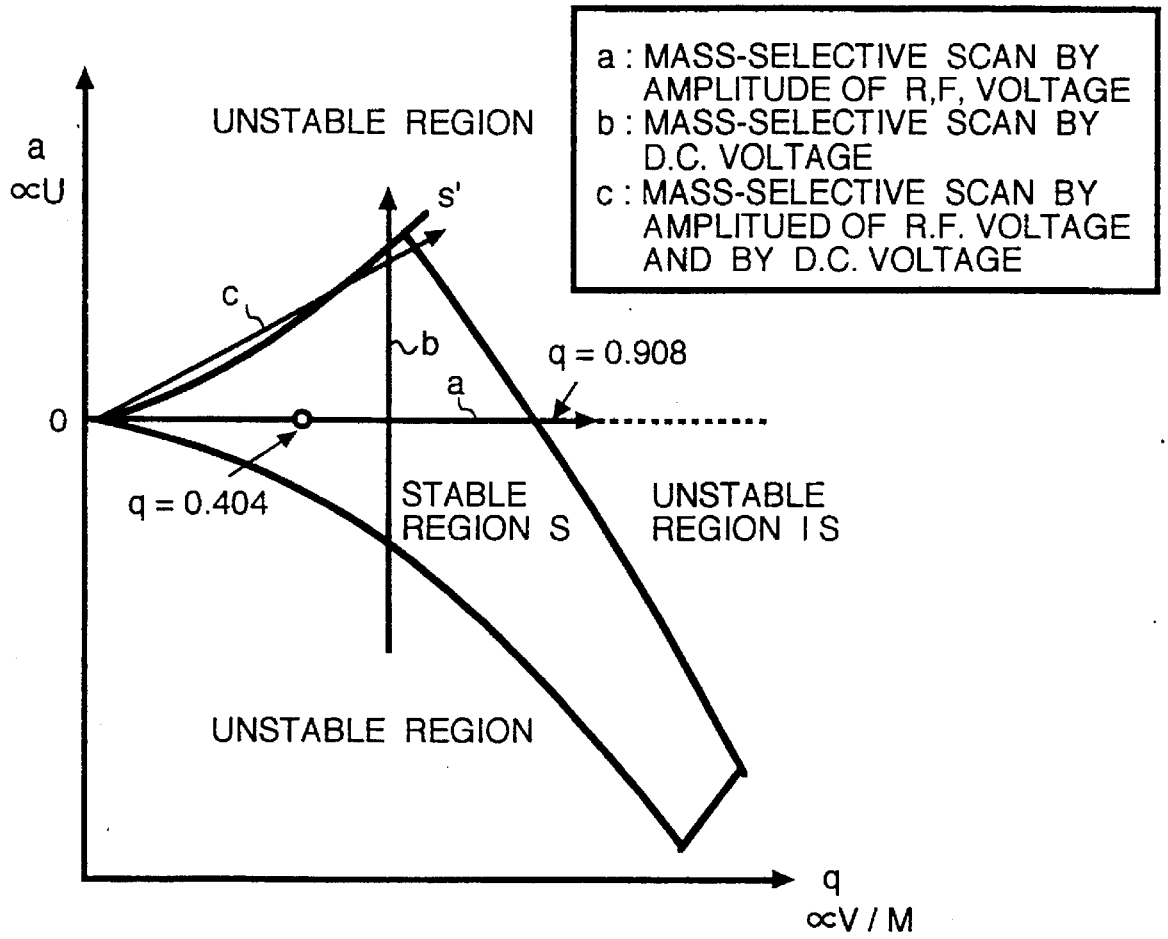
FIG. 24 is a characteristic graph showing the stable region and the unstable region for a trajectory of ion species inside an ion trap expressed by a- and q-values.
Figure 25:
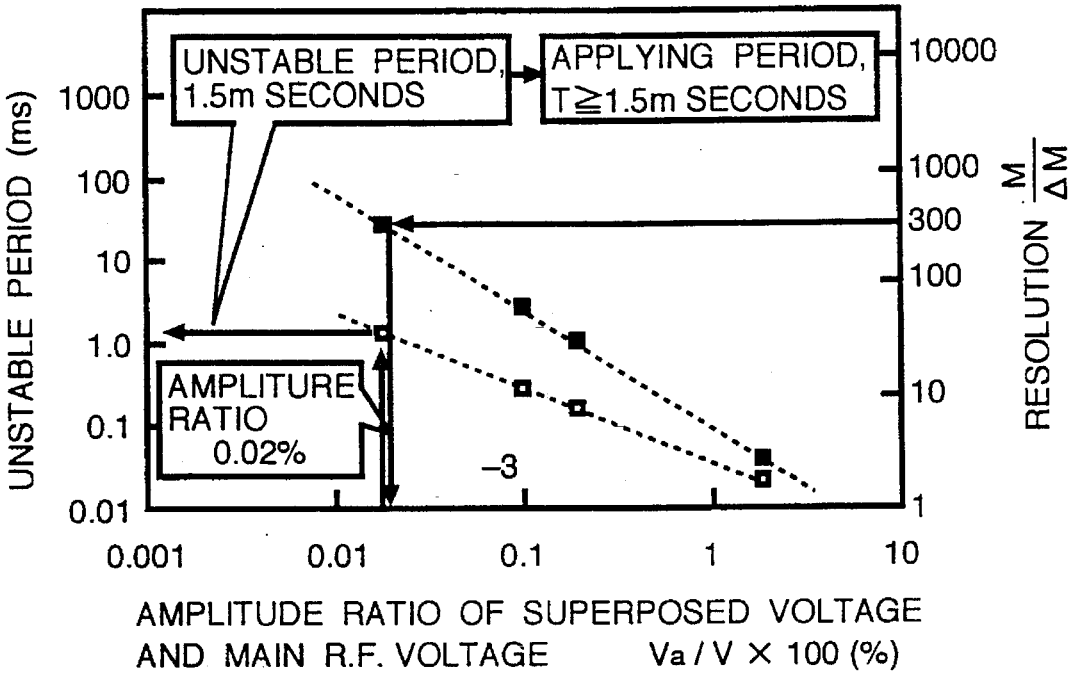
FIG. 25 is a graph showing a numerical analyzing result of relationship between amplitude ratio of the auxiliary voltage to the radio frequency voltage and mass resolution, and time required for unstabilizing an ion trajectory.

By the resonance ejection, an ion species having a specified mass can be unstabilized to be ejected since an auxiliary electric field generated by the auxiliary alternating current voltage applied to the end cap electrodes 7, 8 from the power source 11 for auxiliary alternating current voltage corresponds to a resonating ion mass number (mass-to-charge ratio) one-to-one. Needless to say, the auxiliary electric field is very weaker than the quadrupole electric field due to the characteristic of ion trap. The amplitude of the auxiliary alternating current voltage closely relates to mass spectral resolution of resonance ejection and time required for unstabilization and ejection of each ion species (hereinafter, referred to as "unstabilization time"). FIG. 25 shows a result of numerical analysis on the above relation when a resonance point (characteristic point) in FIG. 24 is a=0, q=0,404. This graph shows the relationship of the unstabilization time [ms] and the mass resolution (M/ΔM) versus the amplitude ratio of the superposed voltage to the radio frequency voltage $(V_a/V)\times 100[\%]$. This calculation result does not consider interaction of ions with a neutral gas and the other ions. This relationship gives a magnitude of amplitude ratio of the auxiliary voltage to the radio frequency voltage necessary for attain a required mass resolution and further gives a minimum time required for a mass spectrometry. For example, in a case where a resonance point is a=0, q=0.404 and a required mass resolution is nearly 300, the amplitude of the auxiliary voltage is set so that the amplitude ratio of the auxiliary voltage to the radio frequency voltage becomes 0.02% and the time required for mass spectrometry of one ion species is set to 1.5 ms or longer. The optimum amplitude ratio and the minimum required time for mass spectrometry of one ion species are different depending on the q-value (resonance point). For example, in a case where the resonance point is a=0, q=0.808 and the required mass resolution is nearly 300, the required amplitude ratio becomes 0.04% and the analyzing time (time required for mass spectrometry of one ion species with mass resolution of 300) is 0.4 ms at minimum. In general, it can be understood from the analytical result that as the q-value (resonance point) is larger, the amplitude ratio can be set larger and the analyzing time of one ion species can be set smaller in order to attain the same mass resolution. In other words, it can be understood that when the amplitude ratio of auxiliary alternating current voltage to the radio frequency voltage is the same, mass spectrometry can be performed with a higher mass resolution and a higher analyzing speed as the q-value is larger.

Figure 15:
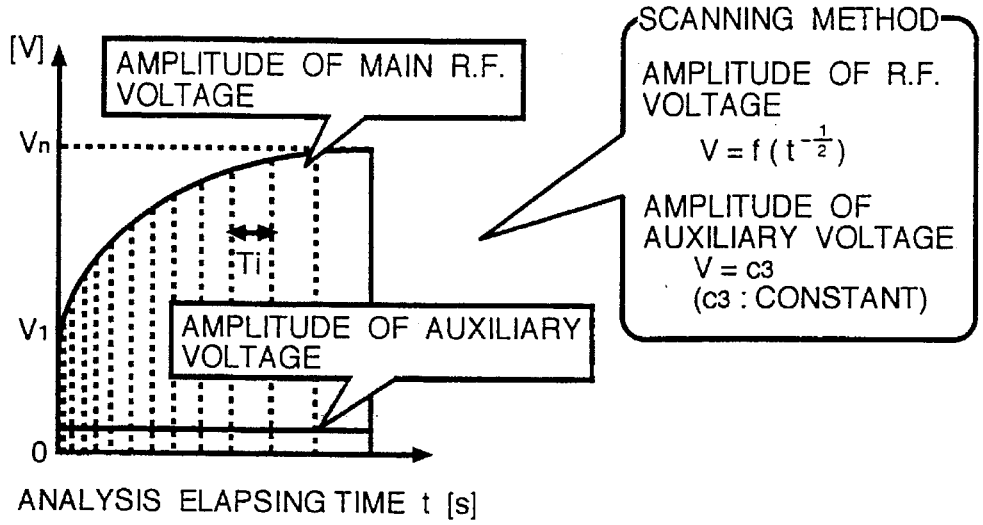
FIG. 15 is an explanatory graph showing a scanning method of a radio frequency voltage and an auxiliary voltage in the first embodiment of the mass spectrometer in accordance with the present invention.

When full width of half maximum of each mass spectrum ΔM is set to M/ΔM=0.5, a necessary mass resolution M/ΔM to each ion species within a certain mass range becomes M/ΔM=2.0×M. From the relationship of FIG. 25, the necessary mass resolution varies corresponding to each mass-to-charge ratio of ion species. FIG. 15 shows one example of scanning method of the amplitude ratio of the auxiliary voltage to the radio frequency voltage corresponding to each mass resolution.

In the method of the present embodiment shown in FIG. 15, different from a conventional method shown in FIG. 26, the amplitude of the radio frequency voltage is scanned so as to be expressed by a function of +½ power of elapsed time of mass selection as shown by Equation (4), that is, so as to be proportional to ½ power of elapsed time of mass selection while a constant amplitude of the resonance voltage is applied as the same as in the conventional method.

$$V=C_1(t+C_2)^{1/2}+C_3 \quad (4)$$

[$C_1$, $C_2$, $C_3$] are constant)

In this case, the scanning is performed within the range of the mass-to-charge ratios of interest ion species. For example, the amplitude of the radio frequency voltage is scanned according to Equation (4) proportional to mass-to-charge ratio within the range ($V_1$ to $V_n$) of the radio frequency voltages corresponding to the range ($M_1$ to $M_n$) of the mass-to-charge ratios of interest ion species. As a result, as the mass-to-charge ratio of interest ion species becomes large, the amplitude ratio of the auxiliary voltage to the radio frequency voltage becomes low and the resolution of mass selection becomes high. In the example of FIG. 15, the amplitude of the radio frequency voltage is set to $V=f(t_{1/2})$, the amplitude of the auxiliary voltage is set to $V=C_3$ where $C_3$ is a constant, $V_1$ corresponds to mass-to-charge ratio $M_1$, $V_n$ corresponds to mass-to-charge ratio $M_n$. The analyzing time $T_i$allocated to i-th ion species is proportional to $M_i$.

In the method of the present embodiment, necessary and sufficient time for unstabilizing ion species to be analyzed with necessary mass resolution is allocated based on the characteristic of FIG. 25, and the mass-to-charge ratio is, therefore, scanned so as to remove excess analyzing time. In other words, if scanning of mass-to-charge ratio is performed based on the characteristic of FIG. 25, the total analysis time for the range of all ion species can be largely shortened by setting the amplitude ratio of the auxiliary voltage to the radio frequency voltage large for ion species which can be sufficiently selected with a low mass resolution within the attainable range of a target mass resolution during analyzing ion species within the range of interest ion species to shorten the allocated time by rapidly unstabilize the ion species.

Shortening of analysis time, when the embodiment is applied, will be described in detail below. Let the range of mass-to-charge ratio of interest ion species be $M_1$ to $M_n$, and allocated time necessary for unstabilizing all ion species up to an ion species having the maximum mass-to-charge ratio $M_n$ within the range of interest ion species be $\Sigma\Delta t_i$ (where i is an integer and $1 \leqq i \leqq n$; hereinafter, the same). According to the conventional method, time allocated to mass selection of each ion species is a constant At throughout the total range of the mass-to-charge ratios. Therefore, the total analysis time $T_0$becomes as follows.

$$\begin{aligned} T_0 &= \{M_n-(M_1-1)\}\times\Delta t \\ &= (M_n-M_1+1)\times\Delta t \end{aligned} \quad (5)$$

On the other hand, when a resonance ejection point (q-value) is constant, the unstabilization time $\Delta t_i$ of ion species $M_i$ becomes as follows according to the characteristic shown in FIG. 25.

$$\Delta t_i=(\Delta t/M_n)M_i \quad (6)$$

[$\Delta t$ is time necessary for mass analyzing $M_n$]

Since at least each unstabilization time of each ion species is required for each analysis time of each ion species, the shortest total analysis time of all ion species in this embodiment is the sum of each unstabilization time of each ion species. Therefore, the total analysis time T becomes as follows.

$$\begin{aligned} T &= \Sigma\Delta t_i \\ &= (\Delta t/M_1)\Sigma M_i \\ &= (\Delta t/M_n)(1/2)\{M_n(M_n+1)-(M_1-1)M_1\} \end{aligned} \quad (7)$$

The reduced amount of analysis time $\Delta T=T_0-T$ can be obtained from Equation (5) and Equation (7) as follows.

$$\begin{aligned} \Delta T &= (\Delta t/2M_n)\{2(M_n-M_1+1)-M_n(M_n+1)+(M_1-1)M_1\} \\ &= (\Delta t/2M_n)\{2M_n^2-2M_1M_n+2M_n-M_{n2}-M_n+M_1^2-M_1\} \\ &= (\Delta t/2M_n)\{M_n^2+M_n-2M_1M_n+M_1^2-M_1\} \\ &= (\Delta t/2M_n)\{(M_n-M_1)^2+(M_n-M_1)\} \\ &= (\Delta t/2M_n)(M_n-M_1)(M_n-M_1+1) \end{aligned} \quad (8)$$

Since in most cases $M_1 \ll M_n$, it can be understood from Equation (8) that the total analysis time according to the present embodiment can be reduced to one-half sa short as that in the conventional method.

Figure 16:
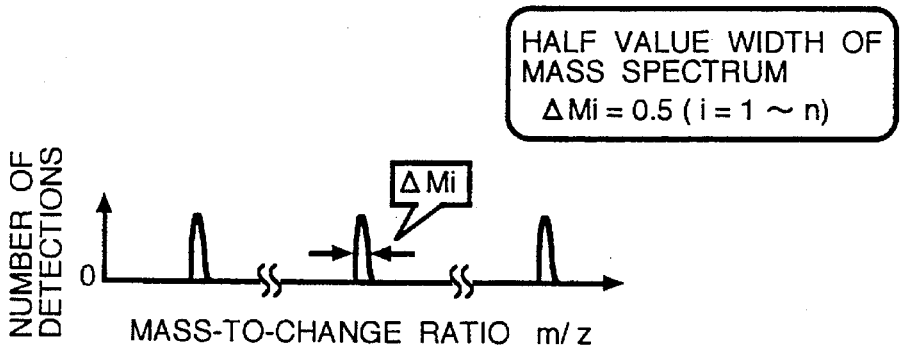
FIG. 16 is a conceptual chart of mass spectrums obtained when the first embodiment of the mass spectrometer in accordance with the present invention is operated.

The mass spectrums obtained by this method has a mass resolution capable of sufficiently discriminating a spectrum from the adjacent spectrum since the full width of half maximum of mass spectrum is kept to $\Delta M=0.5$ throughout the total range, as shown in FIG. 16. When the full width of half maximum of mass spectrum is set to a value other than 0.5, the required full width of half maximum of mass spectrum can be obtained by setting the coefficients $C_1$, $C_2$, $C_3$ in Equation (4) so as to match with the required full width of half maximum of mass spectrum.

Time t for analyzing an arbitrary ion species having mass-to-charge ratio m can be obtained from Equation (8) as follows.

$$t=(\Delta t/2M_n)\{m(m+1)-M_1(M_1-1)\}$$

Therefore, by using coefficients B and C, the time t for analyzing an arbitrary ion species having mass-to-charge ratio m can be expressed as follows.

$$t=Bm(m+1)-C \quad (9)$$

When the resonance ejection point is determined, V can be expressed as following from Equation (1).

$$V=qmr_0^2\Omega^2/4e \quad (10)$$

By putting A as $$A=qr_0^2\Omega^2/4e,$$

Equation (10) becomes, $$V=A\cdot m \quad (11)$$

Then, m is expressed as follows.

$$m=V/A \quad (12)$$

By substituting m into Equation (9), $$\begin{aligned} t &= B(V/A)(V/A+1)-C \\ &= (B/A^2)V(V+A)-C \end{aligned} \quad (13)$$

Thereby, from $$(B/A^2)V^2+(B/A^2)V-C+t=0,$$

the following equation can be obtained, $$V^2+AV-(A^2/B)(t+C)=0. \quad (14)$$

By solving the above equation, V becomes as follows.

$$\begin{aligned} V &= (1/2)[-A+\{A^2+(t+C)4A^2/B\}^{1/2}] \quad (15)\\ &= (A/2)[-1+\{1+4(t+C)4/B\}^{1/2}]\\ &= (A/2)[\{4/B)t+(4/B)C+1\}^{1/2}-1]\\ &= (A/2)(2/B^{1/2})[\{t+C+(B/4\}^{1/2}-(B^{1/2}/2)]\\ &= (A/B^{1/2})\{t+C+(B/4\}^{1/2}-(A/2) \end{aligned}$$

Therein, by rewriting as follows, Equation (4) described above can be obtained.

$$C_1=A/B^{1/2}$$

$$C_2=C+(B/4)$$

$$C_3=-A/2.$$

As described above, according to the first embodiment, it is possible to perform mass spectrometry capable of attaining a target mass resolution with one-half time as short as by the conventional method. It is known that when the whole analysis is performed taking a very long time, ions are strongly affected by interaction with a neutral gas and other ions existing inside the volume between electrodes and consequently positions of mass spectrums are largely displaced (mass shift). Therefore, by shortening the total analysis time, it is possible to suppress degradation of accuracy in mass spectrometry result.

[Embodiment 2]

A second embodiment of the present invention will be described, referring to FIG. 17. The different point of this embodiment from the first embodiment described above is that the range of mass-to-charge ratio of interest ion species is divided into plural regions to be scanned. The other points not to be described are constructed in the same as in the first embodiment. Therefore, like parts in this embodiment are identified by the same reference characters, and over-lapped description will be omitted.

In this embodiment, the range of mass-to-charge ratio of interest ion species is divided into plural regions, and each of the regions is scanned according to a function of the first degree as shown by Equation (16).

$$V=D_1t+D_2,\ [D_1,\ D_2 \text{ are constant}] \quad (16)$$

That is, when the amplitude of the radio frequency voltage is scanned at a constant scanning speed, in the present embodiment ion mass within the range of interest ion species is analyzed by changing the scanning speed ($D_1$ value). In FIG. 17, the whole range of mass-to-charge ratio is divided into three regions A, B, C, and by changing scanning speed (gradient) for each region the amplitude of the radio frequency voltage is varied at a constant speed. The scanning speed of the amplitude of the radio frequency voltage is slower (the gradient is lessened) in the region of higher mass-to-charge ratio. In the case of FIG. 17, since the average value of the mass-to-charge ratio increases in order of regions A, B, C, the scanning speed is decreased in this order.

Figure 17:
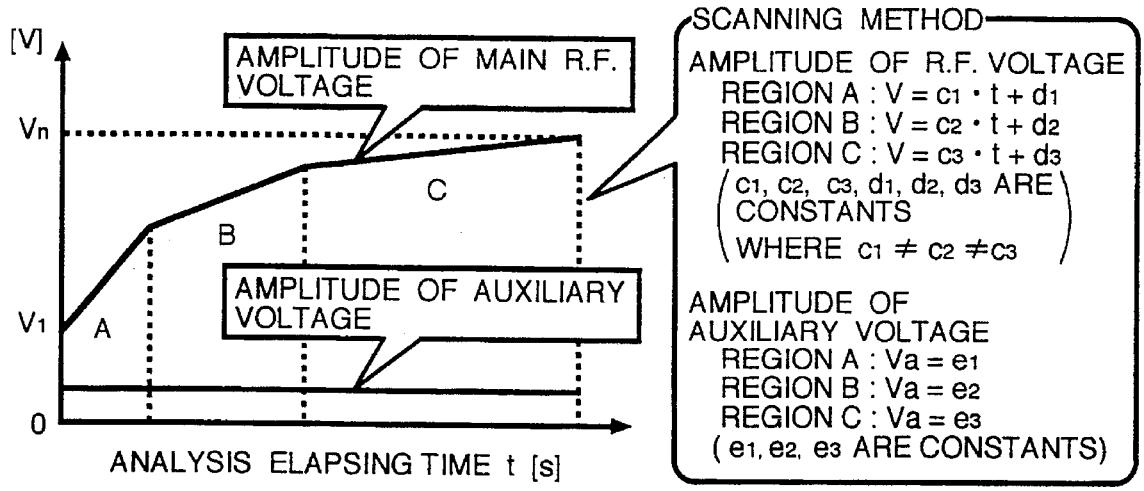
FIG. 17 is an explanatory graph showing a scanning method of a radio frequency voltage and an auxiliary voltage in the second embodiment of the mass spectrometer in accordance with the present invention.

Therefore, in FIG. 17, the coefficient $D_1$ is set to $c_1$, $c_2$, $c_3$ ($c_1>c_2>c_3$) and the coefficient $D_2$ is set to $d_1$, $d_2$, $d_3$ corresponding to the regions A, B, C. Then, $V=c_1t+d_1$ in the region A, $V=c_2t+d_2$ in the region B, and $V=c_3t+d_3$ in the region C. The amplitude of the auxiliary voltage $V_a$ is set to $V_a=e_1$, $V_a=e_2$, $V_a=e_3$ corresponding to the region A, B, C where $e_1$, $e_2$, $e_3$ are constant.

According to the present embodiment, since the scanning speed of the radio frequency voltage is changed according to the level of the mass-to-charge ratio of each region, the analyzing time of each ion species is varied depending on each region and consequently the total analyzing time is shortened. Further, in this embodiment, since the amplitude of the radio frequency voltage is scanned at a constant speed, a conventional technology can be employed and scanning of the radio frequency voltage can be performed easily compared with the first embodiment. The amplitude of the auxiliary voltage may be varied as far as the amplitude ratio of the auxiliary voltage to the radio frequency voltage is within a range capable of attaining a required mass resolution. However, the controller 3 controls to determine the values $D_1$, $D_2$ in Equation (16) for each regions so that time longer than necessary unstabilization time for the amplitude ratio of the auxiliary voltage and the radio frequency voltage at that time can be allocated to analysis of each ion species.

[Embodiment 3]

A third embodiment of the present invention will be described, referring to FIG. 18. This embodiment is the same as the second embodiment in that the range of mass-to-charge ratio of interest ion species is divided into plural regions to be scanned. The different point of this embodiment from the second embodiment is that each region is scanned with different method from the second embodiment. The other points not to be described are constructed in the same as in the first and the second embodiments. Therefore, like parts in this embodiment are identified by the same reference characters, and over-lapped description will be omitted.

That is, in this embodiment, a region particularly requiring a high mass resolution within the range of mass-to-charge ratio of interest ion species is divided and only the region is mass analyzed by lowering the scanning speed for the amplitude of the radio frequency voltage. For example, in a case where ion species containing atoms having an isotope is mass selected by isotope, a very high mass resolution such that the full width of half maximum of mass spectrum AM becomes $\Delta M<<0.5$ is required. In a region requiring such a high mass resolution, the amplitude ratio of the auxiliary voltage to the radio frequency voltage is decreased very small and correspondingly the mass analyzing time allocated to the ion species is increased very long based on the characteristic of FIG. 25. That is, it is required to decrease the scanning speed of the amplitude of the radio frequency voltage very small. Since the amplitude of the radio frequency voltage corresponds to the mass number of ion species, the amplitude ratio of the auxiliary voltage to the radio frequency voltage is commonly decreased by decreasing the amplitude of the auxiliary voltage in order to not change the scanning range of the amplitude of the radio frequency voltage.

Figure 18:
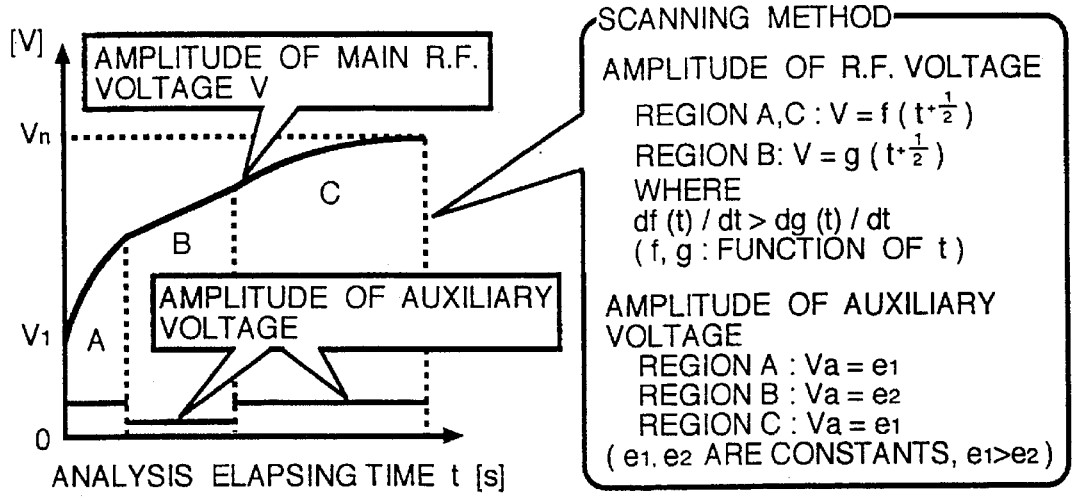
FIG. 18 is an explanatory graph showing a scanning method of a radio frequency voltage and an auxiliary voltage in the third embodiment of the mass spectrometer in accordance with the present invention.
Figure 19:
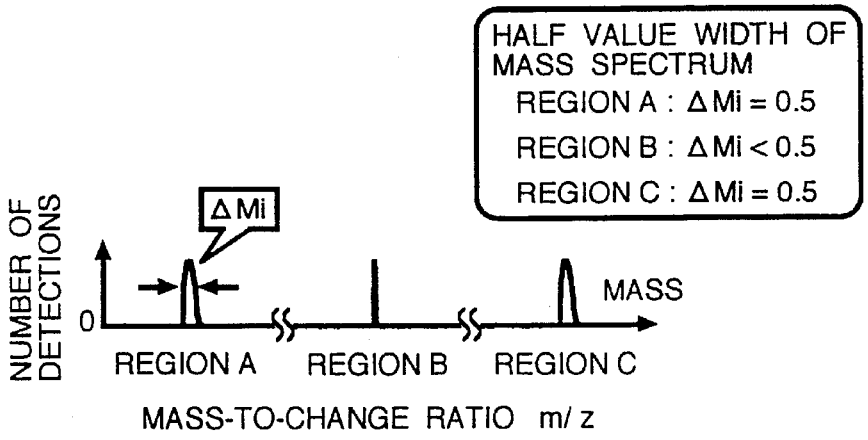
FIG. 19 is a conceptual chart of mass spectrums obtained when the third embodiment of the mass spectrometer in accordance with the present invention is operated.

FIG. 18 shows an example of a detailed scanning method of this embodiment. Assuming that the region B among the regions A, B, C requires a high mass resolution, for this region an auxiliary voltage having a very small constant amplitude compared to in the other regions is applied and during that time the amplitude of the radio frequency voltage is scanned at a very slow speed. On the other hand, for the regions A, C where the mass resolution of the half vale width $\Delta M$ of mass spectrum of $\Delta M=0.5$ is sufficient, scanning is performed in the same way as in the first embodiment. FIG. 19 is a conceptual chart showing mass spectrums obtained in this method. The full width of half maximum of mass spectrum ΔM corresponding to an ion species in the region B is ΔM<<0.5, and for the other regions mass spectrums having a mass resolution corresponding to the full width of half maximum of mass spectrum ΔM=<<0.5 can be obtained. More particularly, as shown in FIG. 18, the amplitude of the radio frequency voltage is set as $V=f(t^{1/2})$ for the regions A and C, and $V=g(t^{1/2})$ for the region B [where df(t)/dt>dg(t)/dt], and the auxiliary voltage $V_a$ is set as $V_a=e_1$ for the regions A and C, and $V_a=e_2$ for the region B [where $e_1$, $e_2$ are constant, and $e_1>e_2$].

Therefore, according to the present embodiment, even if there is a region requiring a high mass resolution in the middle of a range of mass-to-charge ratio of interest ion species, mass spectrometry capable of attaining a target mass resolution can be performed at a high speed by dividing the range of mass-to-charge ratio by the level of required mass resolution and adjusting the amplitude of the auxiliary voltage for each region.

[Embodiment 4]

A fourth embodiment of the present invention will be described, referring to FIG. 20.

Figure 20:
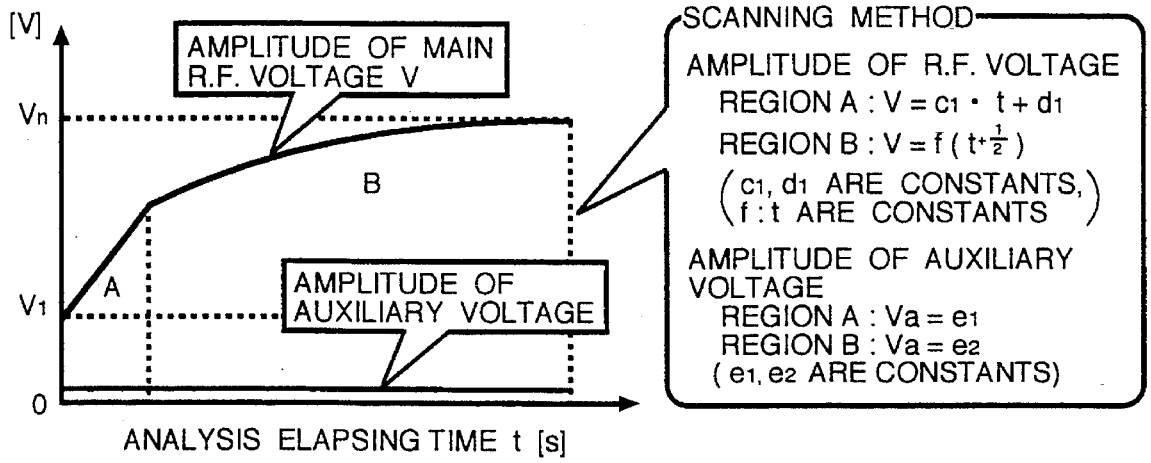
FIG. 20 is an explanatory graph showing a scanning method of a radio frequency voltage and an auxiliary voltage in the fourth embodiment of the mass spectrometer in accordance with the present invention.

In this embodiment, as shown in FIG. 20, the range of mass-to-charge ratio of interest ion species is divided into plural regions, and for the region A corresponding to low mass number ion species the amplitude of the radio frequency voltage is linearly varied to analysis elapsing time as Equation (16), and for the region B corresponding to high mass number ion species the amplitude of the radio frequency voltage is scanned so as to become ½ power function of analysis elapsing time as Equation (4). The other points not to be described are constructed in the same as in the first and the second embodiments. Therefore, like parts in this embodiment are identified by the same reference characters, and over-lapped description will be omitted.

In more detail, the region is divided into A and B, and for the region A the amplitude of the radio frequency voltage is set as $V=c_1t+d_1$, for the region B the amplitude of the radio frequency voltage is set as $V=f(t^{1/2})$, for the region A the amplitude of the auxiliary voltage is set as $V_a=e_1$, and for the region B the amplitude of the auxiliary voltage is set as $V_a=e_2$ [where $e^1$ and $e_2$ are constant].

According to this embodiment, since the amplitude of the radio frequency voltage is varied at a constant speed for the low mass number region, a certain length of analysis time is equally allocated and consequently an ion species having an m/Z value adjacent to the m/Z value of an interest ion species can be sufficiently separated from the interest ion species. As described above, by changing scanning method of the amplitude of the radio frequency voltage for each region depending on the mass-to-charge ratio of interest ion species, it is possible to perform optimum mass selection for each region.

[Embodiment 5]

A fifth embodiment of the present invention will be described, referring to FIG. 24.

In this embodiment, the scanning method of the amplitude of the radio frequency voltage is changed by the q-value in the stability region diagram of FIG. 24, and the other parts are constructed in the same as the first embodiment described above. FIG. 25 shows the relationship of the unstabilization time and the mass resolution versus the amplitude ratio of the auxiliary voltage to the radio frequency voltage when the resonance point in the stability region diagram is a=0, q=0.404. The optimum value of the constants $C_1$, $C_2$, $C_3$ in Equation (4) expressing scanning method of the amplitude of the radio frequency voltage based on the relationship are varied depending on the q-value. From a further detailed numerical analysis, it is known that there is the following relationship between the amplitude ratio Va/V of the auxiliary voltage to the radio frequency voltage and the amplitude of the auxiliary voltage $V_a$.

$$V_a/V \propto q/R \tag{17}$$

$$V_a \propto q^2/R \tag{18}$$

Therefore, by resetting the constants $C_1$, $C_2$, $C_3$ in Equation (4) and $D_1$, $D_2$ in Equation (16) depending on the resonance point, that is, q-value, it is possible to perform an accurate and optimum mass spectrometry at a high speed and with high resolution. That is, since interval between an interest ion species and an ion species having an m/Z value adjacent to the m/Z value of the interest ion species becomes wide as the q value becomes large and consequently the mass resolution becomes high. Therefore, it is possible to preform efficient detection by selecting an optimum q-value depending on the interest ion species with taking detection accuracy and detecting time into consideration.

[Embodiment 6]

A sixth embodiment of the present invention will be described, referring to FIG. 24.

Although only the radio frequency voltage is applied as the operating voltage in the first embodiment, both of a direct current voltage and the radio frequency voltage may be applied. In this case, as for scanning method of mass-to-charge ratio there are at least two scanning methods along the following straight lines.

$$a=x_1 \cdot qx_2 \tag{19}$$

$$a=x_3 \tag{20}$$

In the case of the former scanning method, both of the direct current voltage and the radio frequency voltage are scanned as shown by a straight line c in the figure. Since effect of space charge can be reduced by reducing number of ions stably trapped in the ion trap utilizing a stable region in the upper portion of the straight line c, the mass spectrometry can be performed more accurately. Further, since a stabile region and a superposed region can be arbitrarily set by changing the gradient of the straight line c, it is possible pt perform analysis as required. Furthermore, in a case where the amplitude of the radio frequency voltage becomes very large and dangerous during scanning, by employing the latter scanning method, it is possible to perform mass spectrometry more safely by scanning the direct current voltage. The other parts not particularly described here are the same as in the first embodiment.

[Embodiment 7]

A seventh embodiment of the present invention will be described, referring to FIG. 21.

This embodiment is characterized by comprising a controller 3 capable of changing scanning method for mass-to-charge ratio corresponding to a required mass resolution of interest ion species and an auxiliary voltage power source 14 capable of controlling the ejection direction of ions ejected by resonance. That is, an auxiliary alternating current voltage power source for ejecting a specified direction is provided instead of the auxiliary alternating current voltage power source in the first embodiment of FIG. 1. The other parts not particularly described here are the same as in the first embodiment.

Ions may be unstabilized in both of the directions pointing toward the two end cap electrodes 7, 8. In a mass spectrometer of ion trap type usually has a detector 9 in one side of the end cap electrode (in this embodiment, in the side of the lower end cap electrode 8), as shown in FIG. 21. Therefore, an auxiliary voltage, which generates an auxiliary electric field in the direction pointing only one side toward the end cap electrode using the auxiliary alternating current voltage power source for ejecting one side (specified direction) so that ions to be unstabilized are unstabilized in the direction pointing only the side of the end cap electrode 8 where the detector 9 exists. By doing so, since ions are apt to be unstabilized in the direction pointing only the side of the end cap electrode 8 where the detector 9 exists, the detecting efficiency can be improved.

According to this embodiment, it is possible to perform high sensitive, high speed and high mass resolution mass spectrometry.

[Embodiment 8]

Figure 22:
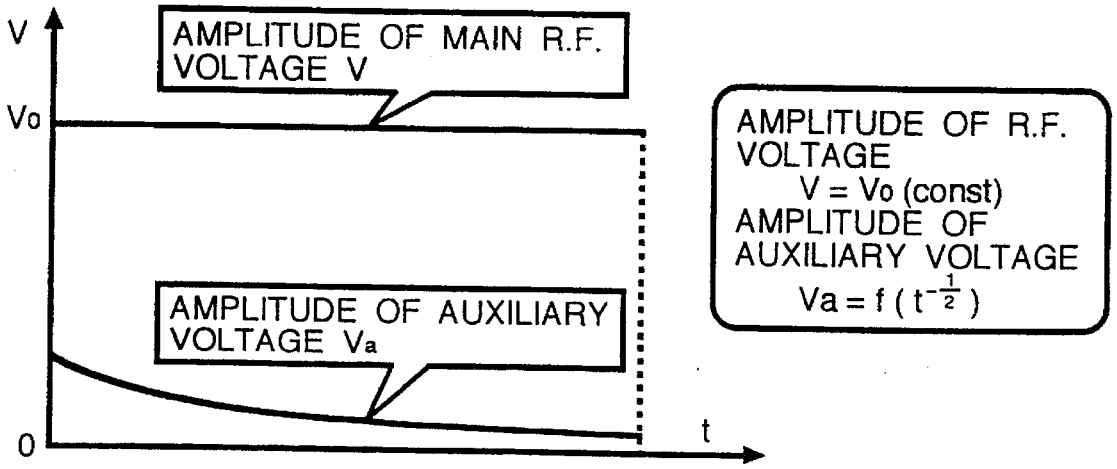
FIG. 22 is an explanatory graph showing a scanning method of a radio frequency voltage and an auxiliary voltage in an eighth embodiment of the mass spectrometer in accordance with the present invention.
Figure 23:
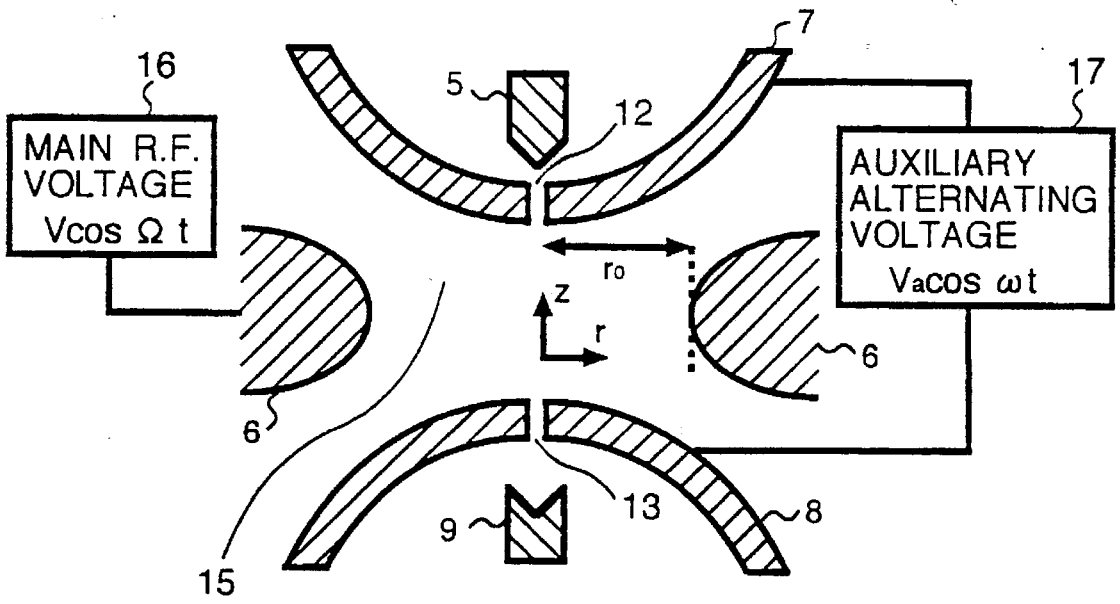
FIG. 23 is a step explanatory view showing electrodes in an example of a conventional trap.

An eighth embodiment of the present invention will be described, referring to FIG. 22.

This embodiment is characterized by a scanning method of mass-to-charge ratio of interest ion species in which the frequency of the radio frequency voltage is varied.

When the amplitude ratio of the auxiliary voltage to the radio frequency voltage is varied corresponding to change of a required mass resolution, the amplitude of the radio frequency voltage is kept constant as expressed by $V=V_0$ (constant). Therefore, the amplitude of the auxiliary voltage to be superposed is varied in synchronizing with scanning of mass-to-charge ratio. For example, in a case of mass scanning based on a function of ½ power of analysis elapsed time, the amplitude $V_a$ of the auxiliary voltage is scanned so as to expressed by the following function of analysis elapsed time, as shown in FIG. 22.

$$V_a=E_1(t+E_2)^{-1/2}+E_3 \quad (21)$$

[$E_1$, $E_2$, $E_3$ are constants]

According to this embodiment, it is possible to perform high speed and high mass resolution mass spectrometry by varying the amplitude $V_a$ of the auxiliary voltage corresponding to a required mass resolution even when mass scanning is performed while the frequency of the radio frequency voltage is varied. However, in a case where the range of mass scanning is divided into plural regions and mass scanning is performed based on a linear function of analysis elapsed time having a different gradient for each region, scanning of $V_a$ is performed so that the amplitude $V_a$ of the auxiliary voltage is expressed by a function of −1 power of analysis elapsed time having a different gradient for each region. The other parts not particularly described here are the same as in the first embodiment.

As have been described above, according to the present invention, by controlling the direction of ejecting the interest ion species from the volume formed by the electrodes so as to be directed at the side existing the detecting means by applying an electric field having the main component in the direction pointing toward the detecting means to the interest ion species with a cycle capable of synchronizing with oscillation in the axial direction of the interest ion species, most of the interest ion species can be detected without loss and consequently the detection efficiency can be largely improved.

By applying an electric field having a direction different from the direction pointing toward the detecting means to a second ion species other than the interest ion species, the direction in which the amplitude of the second ion trajectory rapidly increases is directed in a direction different from the direction pointing toward the detector. Therefore, since effect of the space charge due to the second ions other than the interest ion species can be decreased, and the mass shift caused by the effect can be decreased and the mass resolution can be improved.

By applying an electric field having a direction opposite to the direction pointing toward the detecting means to a second ion species having a mass-to-charge ratio near the mass-to-charge ratio of the interest ion species, and the second ion species is suppressed to be ejected in the direction pointing toward the detector. Therefore, an error measurement can be avoided.

Further, according to the present invention, the amplitude of the auxiliary voltage is adjusted so as to become an amplitude ratio of the auxiliary voltage to the radio frequency voltage corresponding to a necessary mass resolution for each ion species, and with this magnitude of the auxiliary voltage the scanning speed of the amplitude of the radio frequency voltage is controlled so as to allocate analyzing time sufficient to unstabilize a trajectory of each ion species. Therefore, it is possible to perform mass spectrometry capable of attaining a target mass resolution throughout the whole range of mass numbers within a very short time comparing to a conventional method.

That is, ions are ejected by varying the amplitude ratio of an auxiliary alternating current voltage generating an auxiliary alternating current electric field by applying to the end cap electrodes to the radio frequency voltage corresponding to a mass resolution required for mass spectrometry of the interest ion species. Therefore, it is possible to selectively eject one interest ion species by varying the amplitude ratio of the auxiliary voltage to the radio frequency voltage depending on a required mass resolution. As a result, it is possible to perform mass spectrometry capable of attaining a target mass resolution throughout the whole range of mass numbers.

Each ion species having different mass-to-charge ratio is time-sequentially detected by scanning mass-to-charge ratio within the range of the mass-to-charge ratios of the interest ion species. Therefore, it is possible to time-sequentially detected by scanning mass-to-charge ratio within the range of the mass-to-charge ratios. As a result, it is possible to perform continuous mass spectrometry capable of attaining a target mass resolution throughout the whole range of mass numbers.

Time allocated to mass spectrometry for each ion species is varied corresponding to the mass-to-charge ratio of the interest ion species. Therefore, it is possible to set necessary and minimum time required for mass spectrometry corresponding to the mass-to-charge ratio of the interest ion species. As a result, it is possible to perform mass spectrometry in a short time without excess detection time.

The mass spectrometer comprises the control means for varying the amplitude ratio of an auxiliary alternating current voltage generating the auxiliary alternating current electric field by applying to the end cap electrodes to the radio frequency voltage corresponding to a mass resolution required for mass spectrometry of the interest ion species. Therefore, it is possible to perform mass spectrometry capable of attaining a target mass resolution throughout the whole range of mass numbers.

The mass spectrometer comprises the control means for varying the amplitude ratio corresponding to the value of the mass-to-charge ratio of each ion species. Therefore, it is possible to detect the interest ion species with high accuracy and in a short time by setting the amplitude ratio corresponding to the value of the mass-to-charge ratio of each ion species.

The mass spectrometer comprises the control means for varying the amplitude ratio so that a full width of half maximum of mass spectrum peak corresponding to each ion species becomes a target value. Therefore, it is possible to perform mass spectrometry with high mass resolution by setting the amplitude ratio so that the full width of half maximum of mass spectrum becomes the target value. As a result, it is possible to perform mass spectrometry with high mass resolution.

The mass spectrometer comprises the control means for varying the amplitude ratio of the auxiliary alternating current voltage to the radio frequency voltage so as to decrease as the required mass resolution of the interest ion species increases. Since there is a relationship between the mass resolution and the amplitude ratio, it is possible to perform mass spectrometry with high mass resolution by increasing detection accuracy through decreasing the amplitude ratio.

The mass spectrometer comprises the control means for varying the amplitude ratio of the auxiliary alternating current voltage to the radio frequency voltage so as to decrease as the value of mass-to-charge ratio of the interest ion species increases. Since there is a relationship between the mass resolution and the amplitude ratio, it is possible to perform mass spectrometry with high accuracy by decreasing the amplitude ratio as the value of mass-to charge ratio increases.

The mass spectrometer comprises the means for varying the amplitude of the auxiliary alternating current voltage so as to always satisfy a ratio of the auxiliary alternating current voltage to the radio frequency voltage by which a required mass resolution for mass selection of each ion species can be obtained. Therefore, since a required mass resolution can be always kept, it is possible to perform mass spectrometry with high accuracy.

The mass spectrometer comprises the means for scanning the mass-to-charge ratio varying a scanning characteristic of mass-to-charge ratio of interest ion species depending on a point inside a stability region determining stability of an ion trajectory oscillating in a volume between ion trap electrodes in which the ion species is resonated. Therefore, since a scanning characteristic is varied in taking mass resolution and mass spectrometry time into consideration depending on the characteristic, it is possible to perform mass spectrometry with high efficiency.

The mass spectrometer comprises the means for scanning the mass-to-charge ratio by varying the scanning speed corresponding to the mass-to-charge ratio of an interest ion species within the range of the mass-to-charge ratio of the interest ion species, and each ion species having different mass-to-charge ratio is time-sequentially detected. Therefore, it is possible to perform continuous mass spectrometry capable of attaining a target mass resolution throughout the whole range of mass numbers.

The mass spectrometer comprises the means for varying time allocated to mass selection of each ion species by the above scanning means corresponding to the mass-to-charge ratio of the interest ion species. Therefore, since time required for mass spectrometry is set corresponding to the mass-to-charge ratio of the interest ion species, it is possible to perform mass spectrometry with high accuracy and within necessary and minimum time.

The mass spectrometer comprises the varying means for allocating a time period being sufficient to eject each ion species by unstabilizing the ion trajectory as time required for mass selection of each ion species. Therefore, it is possible to certainly detect an interest ion species.

The mass spectrometer comprises the scanning means for varying the scanning speed of the mass-to-charge ratio corresponding to the amplitude ratio of the auxiliary alternating current voltage to the radio frequency voltage. Therefore, by scanning the mass-to-charge ratio in a region requiring high mass resolution with a low speed and a region not requiring high mass resolution with a high speed, it is possible to perform mass spectrometry throughout the whole region of mass-to-charge ratio of interest ion species with necessary and sufficient mass resolution and at a high speed.

The mass spectrometer comprises the scanning means for varying the scanning speed of the mass-to-charge ratio so as to become slower as the amplitude ratio of the auxiliary alternating current voltage to the radio frequency voltage increases. Therefore, since time for unstabilizing ions can be shortened, it is possible to perform mass spectrometry of the whole range of masses as a result.

The mass spectrometer comprises the scanning means for varying the scanning speed of the mass-to-charge ratio corresponding to the mass-to-charge ratio of an interest ion species. Therefore, since speed required for analysis is set corresponding to the mass-to-charge ratio of interest ion species, it is possible to perform mass spectrometry within necessary and minimum time corresponding to the speed.

The mass spectrometer comprises the scanning means for varying the scanning speed of the mass-to-charge ratio so as to become slower as the value of the mass-to-charge ratio of the interest ion species increases. Therefore, since time required for unstabilizing ions can be shortened by decreasing scanning speed, it is possible to perform mass spectrometry of the whole range of masses as a result.

The mass spectrometer comprises the scanning means for performing scanning of the mass-to-charge ratio of the interest ion species by scanning the amplitude of the radio frequency voltage. Therefore, scanning of mass-to-charge ratio of interest ion species can be performed by scanning the radio frequency voltage, scanning becomes simple.

In a case where the amplitude of the radio frequency voltage varies so as to be expressed by a function of +1 power of elapsed time of mass selection for the all ion species within the range of the interest ion species, the range of the mass-to-charge ratio of the interest ion species is divided into at least two regions, and the scanning means scans so that scanning speed of the amplitude of the radio frequency voltage is changed in each region. Therefore, since analysis time per each ion species is varied in each region, the total analysis time can be shortened as a result. Further, since the radio frequency voltage is scanned so as to be expressed by a linear function (constant speed), scanning of the radio frequency voltage becomes simple.

The mass spectrometer comprises the scanning means for scanning with varying the amplitude of the radio frequency voltage so as to be expressed by a function of positive power lower than +1 of elapsed time of mass selection for the all ion species within the range of the interest ion species. Therefore, as the mass-to-charge ratio of interest ion species increases, the amplitude ratio of the auxiliary voltage to the radio frequency voltage decreases and mass resolution becomes higher. Therein, by setting a function of positive power lower than +1 properly, it is possible to arbitrarily set a detection characteristic.

The mass spectrometer comprises the scanning means for scanning by varying the amplitude of the radio frequency voltage so as to be expressed by a function of +½ power of elapsed time of mass selection for the all ion species within the range of the interest ion species. Therefore, as the mass-to-charge ratio of interest ion species increases, the amplitude ratio of the auxiliary voltage to the radio frequency voltage decreases and mass resolution becomes higher.

The mass spectrometer comprises the scanning means for performing scanning of the mass-to-charge ratio of the interest ion species by scanning the frequency of the radio frequency voltage. Since the amplitude of the radio frequency voltage is kept constant, it is possible to perform mass spectrometry with high speed and high mass resolution by varying the amplitude of the auxiliary voltage to be superposed according to a required mass resolution in synchronizing with scanning of mass-to-charge ratio.

The mass spectrometer comprises the scanning means for performing scanning of the mass-to-charge ratio of the interest ion species by scanning the magnitude of the direct current voltage. In a case where the amplitude of the radio frequency voltage becomes very large and dangerous during scanning, by employing the latter scanning method, it is possible to perform mass spectrometry more safely by scanning the direct current voltage.

The mass spectrometer comprises the scanning means for performing scanning of the mass-to-charge ratio of the interest ion species by scanning both of the amplitude of the radio frequency voltage and the magnitude of the direct current voltage. Therefore, since the stabile region and the superposed region of interest ion species can be arbitrarily set, it is possible to perform mass spectrometry with high accuracy in a narrow range if necessary.

The mass spectrometer comprises the means for dividing the range of the mass-to-charge ratio of interest ion species into at least two regions and scanning the mass-to-charge ratio of interest ion species and the amplitude ratio of the radio frequency voltage to the auxiliary voltage with a different scanning characteristic for each region. Therefore, since scanning is performed with proper scanning characteristic for each region, it is possible to perform optimum mass spectrometry for each region depending on the mass-to-charge ratio of interest ion species.

The mass spectrometer comprises the means for controlling the direction of ejecting ions by unstabilizing the ion trajectory by utilizing resonance. Therefore, since ions can be unstabilized in the direction pointing only toward the detector side, it is possible to control ion ejection only the detector side and the detection efficiency can be improved.

What is claimed is:

1. A mass spectrometry method using a mass spectrometer comprising a ring-shaped ring electrode and two end cap electrodes arranged facing each other so as to sandwich said ring electrode, said method comprising the steps of applying at least a radio frequency voltage between a direct current voltage and the radio frequency voltage from a main power supply between said ring electrode and said two end cap electrodes to form a quadrupole electric field in a volume surrounded by said electrodes, and ejecting interest ion species from said volume surrounded by said electrodes by unstabilizing trajectories of said interest ion species among ions trapped in said quadrupole electric field, wherein said interest ion species are ejected and detected by varying the amplitude ratio of an auxiliary alternating current voltage generating an auxiliary alternating current electric field by applying to said end cap electrodes to said radio frequency voltage corresponding to a mass resolution required for mass spectrometry of said interest ion species.

2. A mass spectrometry method using a mass spectrometer comprising a ring-shaped ring electrode and two end cap electrodes arranged facing each other so as to sandwich said ring electrode, said method comprising the steps of applying at least a radio frequency voltage between a direct current voltage and the radio frequency voltage from a main power supply between said ring electrode and said two end cap electrodes to form a quadrupole electric field in a volume surrounded by said electrodes, and ejecting interest ion species from said volume surrounded by said electrodes by unstabilizing trajectories of said interest ion species among ions trapped in said quadrupole electric field, said interest ion species being ejected and detected by varying the amplitude ratio of an auxiliary alternating current voltage generating an auxiliary alternating current electric field by applying to said end cap electrodes to said radio frequency voltage corresponding to a mass resolution required for mass spectrometry of said interest ion species, wherein each ion species having different mass-to-charge ratio is time-sequentially detected by scanning mass-to-charge ratio within the range of the mass-to-charge ratios of said interest ion species.

3. A mass spectrometry method according to claim 2 wherein time allocated to mass spectrometry for each ion species is varied corresponding to the mass-to-charge ratio of the interest ion species.

4. A mass spectrometer comprising a ring-shaped ring electrode and two end cap electrodes arranged facing each other so as to sandwich said ring electrode, means for applying at least a radio frequency voltage between a direct current voltage and the radio frequency voltage from a main power supply between said ring electrode and said two end cap electrodes to form a quadrupole electric field in a volume surrounded by said electrodes, and means for ejecting interest ion species from said volume surrounded by said electrodes by unstabilizing trajectories of said interest ion species among ions trapped in said quadrupole electric field by generating an auxiliary alternating current electric field having a very weak intensity compared to the intensity of said quadrupole electric field, said ion species being ejected from the volume surrounded by said electrodes to be detected, which comprises:

control means for varying the amplitude ratio of an auxiliary alternating current voltage generating the auxiliary alternating current electric field by applying to said end cap electrodes to said radio frequency voltage corresponding to a mass resolution required for mass spectrometry of said interest ion species.

5. A mass spectrometer according to claim 4, wherein said control means varies said amplitude ratio corresponding to the value of the mass-to-charge ratio of each ion species.

6. A mass spectrometer according to claim 4, wherein said control means varies said amplitude ratio so that a full width of half maximum of mass spectrum peak corresponding to each ion species becomes a target value.

7. A mass spectrometer according to claim 4, wherein said control means varies the amplitude ratio of the auxiliary alternating current voltage to the radio frequency voltage so as to decrease as the required mass resolution of the interest ion species increases.

8. A mass spectrometer according to claim 4, wherein said control means varies the amplitude ratio of the auxiliary alternating current voltage to the radio frequency voltage so as to decrease as the value of mass-to-charge ratio of the interest ion species increases.

9. A mass spectrometer according to claim, 4, which further comprises means for varying the amplitude of said auxiliary alternating current voltage so as to always satisfy a ratio of said auxiliary alternating current voltage to the radio frequency voltage by which a required mass resolution for mass selection of each ion species can be obtained.

10. A mass spectrometer according to claim 4, which further comprises means for scanning the mass-to-charge ratio by varying a scanning characteristic of mass-to-charge ratio, for a relationship between the amplitude ratio of the auxiliary alternating current voltage and the radio frequency voltage to the scanning speed, of interest ion species depending on a point inside a stability region determining stability of an ion trajectory oscillating in a volume between ion trap electrodes in which the ion species is resonated.

11. A mass spectrometer according to claim 4, which further comprises means for controlling the direction of ejecting ions from the volume surrounded by the electrodes by amplifying the ion trajectory by utilizing resonance.

12. A mass spectrometer comprising a ring-shaped ring electrode and two end cap electrodes arranged facing each other so as to sandwich said ring electrode, means for applying at least a radio frequency voltage between a direct current voltage and the radio frequency voltage from a main power supply between said ring electrode and said two end cap electrodes to form a quadrupole electric field in a volume surrounded by said electrodes, and means for ejecting interest ion species from said volume surrounded by said electrodes by unstabilizing trajectories of said interest ion species among ions trapped in said quadrupole electric field by generating an auxiliary alternating current electric field having a very weak intensity compared to the intensity of said quadrupole electric field, said ion species being ejected from the volume surrounded by said electrodes to be detected, which comprises means for scanning said mass-to-charge ratio by varying the scanning speed corresponding to the mass-to-charge ratio of an interest ion species within the range of the mass-to-charge ratio of the interest ion species, each ion species having different mass-to-charge ratio being time-sequentially detected.

13. A mass spectrometer according to claim 12, which further comprises means for varying time allocated to mass selection of each ion species by said scanning means corresponding to the mass-to-charge ratio of the interest ion species.

14. A mass spectrometer according to claim 13, wherein said varying means allocates a time period being sufficient to eject each ion species by unstabilizing the ion trajectory as time required for mass selection of each ion species.

15. A mass spectrometer according to claim 13, wherein said scanning means varies the scanning speed of said mass-to-charge ratio corresponding to an amplitude ratio of the auxiliary alternating current voltage to the radio frequency voltage.

16. A mass spectrometer according to claim 15, wherein said scanning means varies the scanning speed of said mass-to-charge ratio so as to become slower as the amplitude ratio of said auxiliary alternating current voltage to said radio frequency voltage increases.

17. A mass spectrometer according to claim 13, wherein said scanning means varies the scanning speed of said mass-to-charge ratio corresponding to the mass-to-charge ratio of an interest ion species.

18. A mass spectrometer according to claim 17, wherein said scanning means varies the scanning speed of said mass-to-charge ratio so as to become slower as the value of said mass-to-charge ratio of the interest ion species increases.

19. A mass spectrometer according to claim 12, wherein said scanning means performs scanning of said mass-to-charge ratio of the interest ion species by scanning the amplitude of said radio frequency voltage.

20. A mass spectrometer according to claim 19, wherein in a case where the amplitude of said radio frequency voltage varies so as to be expressed by a function of +1 power of elapsed time of mass selection for the all ion species within the range of said interest ion species, the range of the mass-to-charge ratio of said interest ion species is divided into at least two regions, said scanning means scanning so that scanning speed of the amplitude of said radio frequency voltage is changed in each region.

21. A mass spectrometer according to claim 19, wherein said scanning means performs scanning by varying the amplitude of said radio frequency voltage so as to be expressed by a function of positive power lower than +1 of elapsed time of mass selection for the all ion species within the range of said interest ion species.

22. A mass spectrometer according to claim 19, wherein said scanning means performs scanning by varying the amplitude of said radio frequency voltage so as to be expressed by a function of +½ power of elapsed time of mass selection for the all ion species within the range of said interest ion species.

23. A mass spectrometer according to claim 12, wherein said scanning means performs scanning of the mass-to-charge ratio of said interest ion species by scanning the frequency of said radio frequency voltage.

24. A mass spectrometer according to claim 12, wherein said scanning means performs scanning of the mass-to-charge ratio of said interest ion species by scanning the magnitude of said direct current voltage.

25. A mass spectrometer according to claim 12, wherein said scanning means performs scanning of the mass-to-charge ratio of said interest ion species by scanning both of the amplitude of said radio frequency voltage and the magnitude of said direct current voltage.

26. A mass spectrometer according to claim 12, which further comprises means for dividing the range of the mass-to-charge ratio of interest ion species into at least two regions and scanning the mass-to-charge ratio of interest ion species and the amplitude ratio of the radio frequency voltage to the auxiliary voltage with a different scanning characteristic for each region.

* * * * *

UNITED STATES PATENT AND TRADEMARK OFFICE

CERTIFICATE OF CORRECTION

PATENT NO. : 5,623,144

DATED : April 22, 1997

INVENTOR(S) : Kiyomi YOSHINARI et al.

It is certified that error appears in the above-identified patent and that said Letters Patent is hereby corrected as shown below:

IN THE TITLE PAGE: Change the title to read: --MASS SPECTROMETER WITH RING-SHAPED ELECTRODE HAVING HIGH ION SELECTION EFFICIENCY AND MASS SPECTROMETRY METHOD THEREBY--.

| Column | Line | |
|---|---|---|
| 1 | 1 | After "SPECTROMETER" insert --WITH--. |
| 1 | 45 | Change "βr" to --ωr--; change "βz" to --ωz--. |
| 2 | 63 | Change "unnecessary" to --unnecessarily--. |
| 2 | 67 | Change "unnecessary" to --unnecessarily--. |
| 3 | 23 | Change "existing" to --exiting--. |
| 5 | 27 | Change "ia" to --is--. |
| 5 | 31 | Change "ia" to --is--. |
| 5 | 35 | Change "ia" to --is--. |

UNITED STATES PATENT AND TRADEMARK OFFICE

CERTIFICATE OF CORRECTION

PATENT NO. : 5,623,144

DATED : April 22, 1997

INVENTOR(S) : Kiyomi YOSHINARI et al.

| Column | Line | |
|---|---|---|
| 7 | 4 | Change "shifts" to --shift--. |
| 8 | 35 | After "closer" insert --to--. |
| 8 | 49 | Change "efficient" to --efficiency--. |
| 8 | 66 | Change "lessening" to --making--. |
| 9 | 39 | Change "voltage" to --voltages--. |
| 10 | 35 | Change "ion" to --ions--. |
| 10 | 37 | After "away" insert --from--. |
| 10 | 47 | Change "from" to --than--. |
| 10 | 64 | Change "a wide" to --wide a--. |
| 11 | 12 | Change "a wide" to --wide a--. |
| 11 | 57 | Change "by that" to --in that--. |
| 11 | 65 | After "subjected" insert --to--. |

UNITED STATES PATENT AND TRADEMARK OFFICE

CERTIFICATE OF CORRECTION

PATENT NO. : 5,623,144

DATED : April 22, 1997

INVENTOR(S) : Kiyomi YOSHINARI et al.

| Column | Line | |
|---|---|---|
| 12 | 26 | Change "the all Cases" to --all the cases-- |
| 12 | 29 | Change "Case" to --case--. |
| 12 | 59 | Change "accompanied" to --accompanying--. |
| 13 | 13 | Change "source" to --sources--. |
| 13 | 37 | After "trap" insert -- |
| 13 | 43 | Change "the all" to --all the--. |
| 13 | 46 | Change "if ion" to --of ions--. |
| 13 | 65 | Change "lager" to --larger--. |
| 14 | 21 | After "very" insert --much--. |
| 14 | 28 | Change "q=0,404." to --q=0.404.--. |
| 14 | 36 | Change "for" to --to--. |

UNITED STATES PATENT AND TRADEMARK OFFICE

CERTIFICATE OF CORRECTION

PATENT NO. : 5,623,144

DATED : April 22, 1997

INVENTOR(S) : Kiyomi YOSHINARI et al.

| Column | Line | |
|---|---|---|
| 15 | 30 | Change "$T_i$allocated" to --$T_i$ allocated--. |
| 15 | 44 | Change "unstablize" to --unstabilizing--. |
| 15 | 54 | Change "At" to --Δt--. |
| 16 | 23 | Change "sa" to --as--. |
| 17 | 8 | Change "{4/B)t" to --{(4/B)t--. |
| 17 | 10 | Change "$(B/4\}^{1/2}$" to --$(B/4)\}^{1/2}$-- |
| 17 | 12 | Change "$(B/4\}^{1/2}$" to --$(B/4)\}^{1/2}$-- |
| 17 | 38 | After "same" insert --way--. |
| 18 | 17 | Change "regions" to --region--. |
| 18 | 30 | After "same" insert --way--. |
| 18 | 45 | Change "decreased" to --made--. |
| 18 | 46 | Change "increased" to --made--. |
| 18 | 49 | After "voltage" insert --to become--. |
| 18 | 63 | Change "vale" to --value--. |
| 19 | 31 | After "same" insert --way--. |

UNITED STATES PATENT AND TRADEMARK OFFICE

CERTIFICATE OF CORRECTION

PATENT NO. : 5,623,144

DATED : April 22, 1997

INVENTOR(S) : Kiyomi YOSHINARI et al.

| Column | Line | |
|---|---|---|
| 20 | 3 | Change "Va/V" to --$V_a$/V--. |
| 20 | 20 | Change "with" to --while--. |
| 20 | 43 | Change "pt" to --to--. |
| 20 | 60 | After "ejecting" insert --in--. |
| 20 | 67 | Change "usually has" to --, there is usually--. |
| 21 | 6 | After "ejecting" insert --to--. |
| 21 | 8 | After "only" insert --toward--. |
| 21 | 14 | Change "high" to --highly--. |
| 21 | 27 | Change "synchronizing" to --synchronization--. |
| 21 | 29 | Before "elapsed" insert --of--. |
| 21 | 31 | Before "expressed" insert --be--; before "elapsed" insert --of--. |

UNITED STATES PATENT AND TRADEMARK OFFICE

CERTIFICATE OF CORRECTION

PATENT NO. : 5,623,144

DATED : April 22, 1997

INVENTOR(S) : Kiyomi YOSHINARI et al.

| Column | Line | |
|---|---|---|
| 21 | 54 | Change "existing" to --exiting--. |
| 22 | 9 | Change "suppressed to be" to --prevented from being--. |
| 22 | 23 | Change "comparing" to --compared--. |
| 22 | 40 | Change "detected" to --detect--. |
| 24 | 52 | Change "with" to --by--. |
| 25 | 43 | Change "only" to --to only--. |
| 25 | 62 | Delete "to" first occurrence. |
| 26 | 42 | Delete "to" second occurrence. |

Signed and Sealed this

Twenty-fifth Day of November, 1997

*Attest:*

*Attesting Officer*

BRUCE LEHMAN

*Commissioner of Patents and Trademarks*